US009662886B2

(12) United States Patent
Genta et al.

(10) Patent No.: US 9,662,886 B2
(45) Date of Patent: May 30, 2017

(54) INKJET PRINTING APPARATUS

(71) Applicant: CANON KABUSHIKI KAISHA, Tokyo (JP)

(72) Inventors: Shin Genta, Yokohama (JP); Masaya Uetsuki, Yokohama (JP); Toshimitsu Danzuka, Tokyo (JP); Kazuo Suzuki, Yokohama (JP); Masataka Kato, Yokohama (JP); Tsuyoshi Ibe, Yokohama (JP); Asako Tomida, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/081,712

(22) Filed: Mar. 25, 2016

(65) Prior Publication Data

US 2016/0303857 A1 Oct. 20, 2016

(30) Foreign Application Priority Data

Apr. 14, 2015 (JP) ..... 2015-082601

(51) Int. Cl.

| | |
|---|---|
| ***B41J 2/165*** | (2006.01) |
| ***B41J 2/175*** | (2006.01) |
| ***B41J 19/14*** | (2006.01) |
| ***B41J 2/17*** | (2006.01) |

(52) U.S. Cl.

CPC ..... *B41J 2/16508* (2013.01); *B41J 2/16517* (2013.01); *B41J 2/16526* (2013.01); *B41J 2/16538* (2013.01); *B41J 2/1714* (2013.01); *B41J 2/17566* (2013.01);

(Continued)

(58) Field of Classification Search

CPC ..... B41J 2/17517

See application file for complete search history.

(56) References Cited

U.S. PATENT DOCUMENTS

2004/0165030 A1* 8/2004 Sakamoto ..... B41J 2/04536 347/23
2006/0203034 A1* 9/2006 Uetsuki ..... B41J 2/16544 347/33

(Continued)

FOREIGN PATENT DOCUMENTS

JP 2006-240174 A 9/2006
JP 2014100791 A * 6/2014

*Primary Examiner* — Shelby Fidler

(74) *Attorney, Agent, or Firm* — Canon U.S.A., Inc. IP Division

(57) ABSTRACT

A printer according to this invention includes a print head, a carriage, a recovery unit, and a controller. The controller causes a recovery operation to be performed based on a total value of two values. Assuming that front and rear arrays of discharge port arrays during outbound movement of the carriage are defined as first and second arrays, respectively, the first value is obtained by multiplying a sum of an amount of ink discharged from the first array during outbound movement of the carriage and an amount of ink discharged from the second array during homebound movement of the carriage by a first coefficient, and the second value is obtained by multiplying a sum of an amount of ink discharged from the second array during outbound movement of the carriage and an amount of ink discharged from the first array during homebound movement of the carriage by a second coefficient.

10 Claims, 30 Drawing Sheets

| | WEIGHTING COEFFICIENT FOR OUTBOUND PRINTING | WEIGHTING COEFFICIENT FOR HOMEBOUND PRINTING |
|---|---|---|
| FIRST DISCHARGE PORT ARRAY GROUP | 5 | 1 |
| SECOND DISCHARGE PORT ARRAY GROUP | 1 | 5 |

(52) U.S. Cl.
CPC ..... *B41J 19/142* (2013.01); *B41J 2002/1657* (2013.01); *B41J 2002/16573* (2013.01)

(56) References Cited

U.S. PATENT DOCUMENTS

2007/0291074 A1* 12/2007 Kawamata ..... B41J 2/16517 347/35
2009/0109258 A1* 4/2009 Nitta ..... B41J 2/16535 347/33

* cited by examiner

FIG. 6A

| | WEIGHTING COEFFICIENT FOR OUTBOUND PRINTING | WEIGHTING COEFFICIENT FOR HOMEBOUND PRINTING |
|---|---|---|
| FIRST DISCHARGE PORT ARRAY GROUP | 5 | 1 |
| SECOND DISCHARGE PORT ARRAY GROUP | 1 | 5 |

FIG. 6B

| | WEIGHTING COEFFICIENT FOR OUTBOUND PRINTING | WEIGHTING COEFFICIENT FOR HOMEBOUND PRINTING |
|---|---|---|
| FIRST DISCHARGE PORT ARRAY GROUP | 5 | 1 |
| SECOND DISCHARGE PORT ARRAY GROUP | 3 | 2 |
| THIRD DISCHARGE PORT ARRAY GROUP | 2 | 3 |
| FOURTH DISCHARGE PORT ARRAY GROUP | 1 | 5 |

FIG. 6C

| | WEIGHTING COEFFICIENT FOR OUTBOUND PRINTING | WEIGHTING COEFFICIENT FOR HOMEBOUND PRINTING |
|---|---|---|
| FIRST DISCHARGE PORT ARRAY GROUP | 5 | 1 |
| SECOND DISCHARGE PORT ARRAY GROUP | 3 | 1 |
| THIRD DISCHARGE PORT ARRAY GROUP | 3 | 1.5 |
| FOURTH DISCHARGE PORT ARRAY GROUP | 2 | 2 |
| FIFTH DISCHARGE PORT ARRAY GROUP | 2 | 2 |
| SIXTH DISCHARGE PORT ARRAY GROUP | 1.5 | 3 |
| SEVENTH DISCHARGE PORT ARRAY GROUP | 1 | 3 |
| EIGHTH DISCHARGE PORT ARRAY GROUP | 1 | 5 |

FIG. 14

| | WEIGHTING COEFFICIENT FOR OUTBOUND PRINTING | WEIGHTING COEFFICIENT FOR HOMEBOUND PRINTING |
|---|---|---|
| FIRST DISCHARGE PORT ARRAY GROUP | 5 | 1 |
| SECOND DISCHARGE PORT ARRAY GROUP | 5 | 1 |
| THIRD DISCHARGE PORT ARRAY GROUP | 3 | 1 |
| FOURTH DISCHARGE PORT ARRAY GROUP | 3 | 1 |
| FIFTH DISCHARGE PORT ARRAY GROUP | 3 | 1 |
| SIXTH DISCHARGE PORT ARRAY GROUP | 2 | 1.5 |
| SEVENTH DISCHARGE PORT ARRAY GROUP | 2 | 1.5 |
| EIGHTH DISCHARGE PORT ARRAY GROUP | 2 | 2 |
| NINTH DISCHARGE PORT ARRAY GROUP | 2 | 2 |
| TENTH DISCHARGE PORT ARRAY GROUP | 1.5 | 2 |
| ELEVENTH DISCHARGE PORT ARRAY GROUP | 1.5 | 2 |
| TWELFTH DISCHARGE PORT ARRAY GROUP | 1 | 3 |
| THIRTEENTH DISCHARGE PORT ARRAY GROUP | 1 | 3 |
| FOURTEENTH DISCHARGE PORT ARRAY GROUP | 1 | 3 |
| FIFTEENTH DISCHARGE PORT ARRAY GROUP | 1 | 5 |
| SIXTEENTH DISCHARGE PORT ARRAY GROUP | 1 | 5 |

FIG. 24A

| | WEIGHTING COEFFICIENT FOR OUTBOUND PRINTING | WEIGHTING COEFFICIENT FOR HOMEBOUND PRINTING |
|---|---|---|
| FIRST DISCHARGE PORT ARRAY GROUP | 5 | 1 |
| SECOND DISCHARGE PORT ARRAY GROUP | 1 | 4 |
| THIRD DISCHARGE PORT ARRAY GROUP | 4 | 1 |
| FOURTH DISCHARGE PORT ARRAY GROUP | 1 | 5 |

FIG. 24B

| | WEIGHTING COEFFICIENT FOR OUTBOUND PRINTING | WEIGHTING COEFFICIENT FOR HOMEBOUND PRINTING |
|---|---|---|
| FIRST DISCHARGE PORT ARRAY GROUP | 5 | 4 |
| SECOND DISCHARGE PORT ARRAY GROUP | 1 | 1 |
| THIRD DISCHARGE PORT ARRAY GROUP | 1 | 1 |
| FOURTH DISCHARGE PORT ARRAY GROUP | 4 | 5 |

FIG. 24C

| | WEIGHTING COEFFICIENT FOR OUTBOUND PRINTING | WEIGHTING COEFFICIENT FOR HOMEBOUND PRINTING |
|---|---|---|
| FIRST DISCHARGE PORT ARRAY GROUP | 5 | 1 |
| SECOND DISCHARGE PORT ARRAY GROUP | 2 | 1.2 |
| THIRD DISCHARGE PORT ARRAY GROUP | 1.5 | 1.5 |
| FOURTH DISCHARGE PORT ARRAY GROUP | 1 | 4 |
| FIFTH DISCHARGE PORT ARRAY GROUP | 4 | 1 |
| SIXTH DISCHARGE PORT ARRAY GROUP | 1.5 | 1.5 |
| SEVENTH DISCHARGE PORT ARRAY GROUP | 1.2 | 2 |
| EIGHTH DISCHARGE PORT ARRAY GROUP | 1 | 5 |

FIG. 24D

| | WEIGHTING COEFFICIENT FOR OUTBOUND PRINTING | WEIGHTING COEFFICIENT FOR HOMEBOUND PRINTING |
|---|---|---|
| FIRST DISCHARGE PORT ARRAY GROUP | 5 | 4 |
| SECOND DISCHARGE PORT ARRAY GROUP | 3 | 2 |
| THIRD DISCHARGE PORT ARRAY GROUP | 1.5 | 1.2 |
| FOURTH DISCHARGE PORT ARRAY GROUP | 1 | 1 |
| FIFTH DISCHARGE PORT ARRAY GROUP | 1 | 1 |
| SIXTH DISCHARGE PORT ARRAY GROUP | 1.2 | 1.5 |
| SEVENTH DISCHARGE PORT ARRAY GROUP | 2 | 3 |
| EIGHTH DISCHARGE PORT ARRAY GROUP | 4 | 5 |

FIG. 27A

| SCAN SPEED | COEFFICIENT ACCORDING TO SCAN SPEED |
|---|---|
| 40 INCHES PER SECOND | 1 |
| 33.3 INCHES PER SECOND | 0.8 |
| 24 INCHES PER SECOND | 0.6 |

FIG. 27B

| DISTANCE BETWEEN PRINT HEAD AND PRINTING MEDIUM | COEFFICIENT ACCORDING TO DISTANCE BETWEEN PRINT HEAD AND PRINTING MEDIUM |
|---|---|
| LARGE | 1.2 |
| SOMEWHAT LARGE | 1 |
| NORMAL | 0.8 |
| SOMEWHAT SMALL | 0.6 |
| SMALL | 0.4 |

FIG. 27C

| HUMIDITY | COEFFICIENT ACCORDING TO USAGE ENVIRONMENT |
|---|---|
| – 30% | 1 |
| 30% – 60% | 0.9 |
| 60% – | 0.8 |

FIG. 27D

| NUMBER OF DISCHARGES AFTER PREVIOUS WIPING | NUMBER OF PRELIMINARY DISCHARGES AFTER WIPING |
|---|---|
| LESS THAN $4 \times 10^8$ | 200 |
| $4 \times 10^8$ OR MORE LESS THAN $6 \times 10^8$ | 400 |
| $6 \times 10^8$ OR MORE LESS THAN $8 \times 10^8$ | 600 |
| $8 \times 10^8$ OR MORE LESS THAN $1 \times 10^9$ | 800 |
| $1 \times 10^9$ OR MORE | 1000 |

INKJET PRINTING APPARATUS

BACKGROUND OF THE INVENTION

Field of the Invention

The present invention relates to inkjet printing apparatuses.

Description of the Related Art

Japanese Patent Laid-Open No. 2006-240174 discloses a technique of counting the number of ink discharges from discharge ports of a print head and performing a recovery process by removing ink adhered on a discharge port surface of the print head by using a wiping member in accordance with the counted discharge value. According to this technique, the discharge port surface of the print head can be effectively cleaned off.

However, it has become evident that the discharge port surface of the print head sometimes cannot be sufficiently cleaned off with the technique disclosed in Japanese Patent Laid-Open No. 2006-240174. Specifically, in an inkjet apparatus of a serial type in particular, an air current (self-generated air current) occurring with the discharging of ink droplets and an air current (inflow air current) occurring with the movement of the print head cause an upward vortex (vortex current) to occur. When floating mist (also called ink droplets in the atmosphere or simply mist) within the printing apparatus becomes caught in the vortex current, the floating mist travels with the vortex current and adheres to the discharge port surface of the print head.

Moreover, according to further studies, it has been found that, when the print head moves, the inflow air current becomes larger toward the discharge port array located at the front side in the moving direction of the print head, whereas the inflow air current becomes smaller toward the discharge port array located at the rear side. Thus, when the print head moves, the ink discharged from the front discharge port array in the moving direction tends to rise more as floating mist, thus causing the amount of floating mist adhering to the vicinity of that discharge port array to increase.

SUMMARY OF THE INVENTION

The present invention provides an inkjet printing apparatus that can prevent deterioration of image quality caused by, for example, a discharge defect or color mixing occurring due to adhesion of floating mist on the discharge port surface of the print head.

The present invention also provides an inkjet printing apparatus including a print head, a carriage, a recovery unit, and a controller. The print head is provided with a plurality of discharge port arrays. Each discharge port array has a plurality of discharge ports, which discharge ink, arranged in a first direction. The plurality of discharge port arrays are provided in a second direction intersecting the first direction. The carriage is configured to reciprocate in the second direction with the print head mounted thereon. The recovery unit is configured to perform a recovery operation for recovering printing performance of the print head. The controller is configured to cause the recovery unit to perform the recovery operation based on a total value of a first value and a second value. Assuming that a front discharge port array and a rear discharge port array of the plurality of discharge port arrays provided in the print head when the carriage moves in an outbound direction are defined as a first discharge port array and a second discharge port array, respectively, the first value is obtained by multiplying a sum of an amount of ink discharged from the first discharge port array when the carriage moves in the outbound direction and an amount of ink discharged from the second discharge port array when the carriage moves in a homebound direction by a first coefficient, and the second value is obtained by multiplying a sum of an amount of ink discharged from the second discharge port array when the carriage moves in the outbound direction and an amount of ink discharged from the first discharge port array when the carriage moves in the homebound direction by a second coefficient, the second coefficient is smaller than the first coefficient.

Further features of the present invention will become apparent from the following description of exemplary embodiments with reference to the attached drawings.

BRIEF DESCRIPTION OF THE DRAWINGS

FIGS. 6A to 6C illustrate coefficients to be applied to the respective discharge port array groups in accordance with the moving direction of the print head.

FIG. 14 illustrates coefficients to be applied to the respective discharge port array groups in accordance with the moving direction of the print head.

FIGS. 24A to 24D illustrate coefficients to be applied to the respective discharge port array groups in accordance with the moving direction of the print heads.

FIGS. 27A to 27D illustrate coefficients to be applied to the respective discharge port array groups in accordance with various variables such as the moving speed of the print head.

DESCRIPTION OF THE EMBODIMENTS

Figure 1:
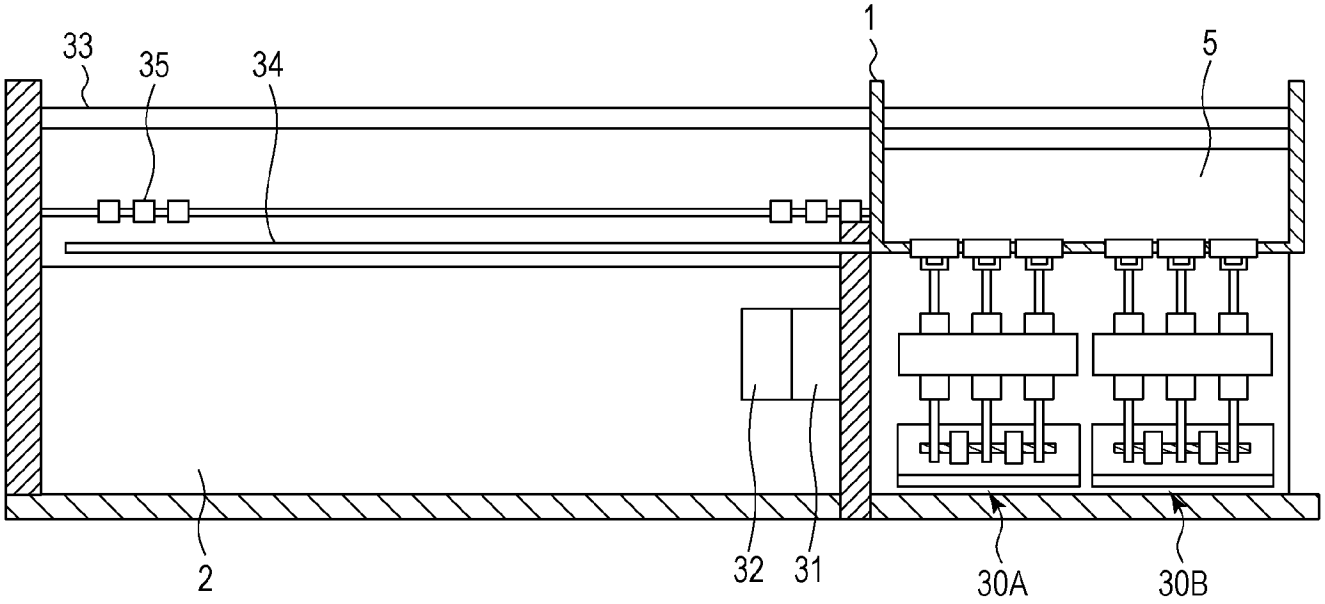
FIG. 1 schematically illustrates an inkjet printing apparatus according to an embodiment of the present invention.

FIG. 1 is a front view illustrating an inkjet printing apparatus according to an embodiment of the present invention. Reference sign 2 denotes a printing apparatus body that includes a conveying unit. This printing apparatus prints an image (including text and diagrams) onto a relatively large printing medium. Reference sign 1 denotes a carriage. The carriage 1 moves while carrying a print head 5 provided with a plurality of discharge portions (discharge port arrays or nozzle arrays) that discharge ink. Reference sign 33 denotes a guide shaft that guides the carriage 1. The carriage 1 receives a driving force via a belt 34 so as to be reciprocally movable along the guide shaft 33. Thus, the print head 5 is movable relatively to a printing medium. The print head 5 discharges ink while the carriage 1 moves reciprocally (i.e., moves in the outbound and homebound directions) so as to print an image onto a printing medium. In this embodiment, a total of four colors of inks, namely, cyan (C), magenta (M), yellow (Y), and black (Bk) inks, are used.

Reference signs 30A and 30B denote recovery mechanisms. The recovery mechanisms 30A and 30B perform a recovery operation for maintaining or recovering the ink discharging performance (printing performance) of the discharge portions of the print head 5 to a good state. The recovery mechanisms 30A and 30B respectively correspond to two discharge portions and have caps that correspond to the respective discharge portions. The caps have a function of covering a discharge port surface of the print head 5 so as to protect the discharge portions and the print head 5 when the print head 5 is not in use. By driving a pump (not shown) in this covered state, a suction force is applied to the discharge portions so that the ink is forcedly drained therefrom (suction recovery operation). Moreover, the ink can be preliminarily discharged into the caps in a state where the caps face the discharge portions. Reference sign 31 denotes an ink receiver box that receives the ink discharged as a result of the preliminary discharging operation. Reference sign 32 denotes a wiping mechanism that performs a wiping operation on the discharge port surface of the print head 5.

In the above configuration, when a printing medium is set at a printing position in accordance with data to be printed, the carriage 1 is controlled so as to move along the guide shaft 33 (i.e., second direction). Then, while the print head 5 is moved in the second direction, the inks are discharged by the discharge portions for the respective color inks. As a result of this operation, an image corresponding to one band (i.e., a region printable in one movement of the print head 5) is printed onto the printing medium. When one band's worth of image printing is completed, the printing medium is conveyed by the conveying unit (not shown) by a predetermined distance (i.e., distance corresponding to the width of one band or the printing width to be printed by a predetermined number of printing elements) in a direction (i.e., first direction) intersecting the moving direction of the carriage 1. Alternatively, in a case where an image is to be printed on the same print area by moving the print head 5 multiple times (i.e., multipass printing), the conveying distance may sometimes be smaller than the aforementioned predetermined distance.

An encoder 35 for detecting the position of the carriage 1 is provided along the moving path of the carriage 1. An encoder sensor installed in the carriage 1 detects the encoder 35 so that the position of the carriage 1 can be confirmed. Based on this positional detection by the encoder 35, the movement of the carriage 1 toward its home position is controlled. The recovery mechanisms 30A and 30B, the wiping mechanism 32, and so on are disposed in the vicinity of this home position.

Figure 2:
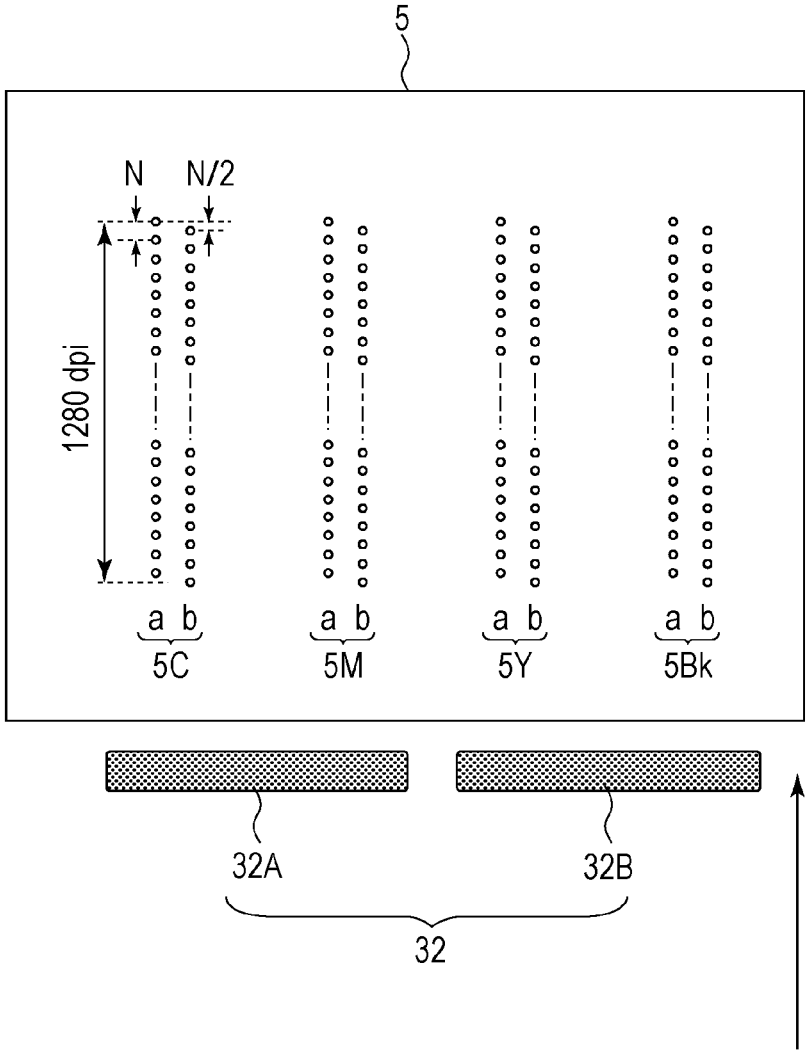
FIG. 2 schematically illustrates the configurations of and the relationship between a print head and a wiping mechanism according to the embodiment of the present invention.

FIG. 2 schematically illustrates the configurations of and the relationship between the print head 5 and the wiping mechanism 32. The print head 5 has discharge portions 5C, 5M, 5Y, and 5Bk that correspond to the C, M, Y, and Bk inks, respectively. Each discharge portion has 1,280 discharge ports arranged with a density of 1200 dots per inch (dpi) in the direction (i.e., vertical direction in FIG. 2) intersecting the moving direction (i.e., horizontal direction in FIG. 2) of the carriage 1 and the print head 5. Furthermore, each of the discharge portions 5C, 5M, 5Y, and 5Bk is constituted of two arrays of discharge ports (arrays a and b in FIG. 2). The array a has 640 discharge ports arranged with a density of 600 dpi at pitch (N) corresponding thereto. The array b has 640 discharge ports arranged with a density of 600 dpi at positions displaced relative to the array a by half pitch (N/2) in the array direction of the discharge ports. An ink path that communicates with the discharge ports is provided with, for example, an electro-thermal converter therein for inducing film boiling by locally heating the ink so as to discharge the ink by using the pressure generated as a result of the film boiling.

The wiping mechanism 32 has a wiper 32A that is capable of wiping the discharge port surfaces of the discharge portions 5C and 5M and a wiper 32B that is capable of wiping the discharge port surfaces of the discharge portions 5Y and 5Bk. In a state where the print head 5 is set at a position corresponding to the wiping mechanism 32, a wiping operation for moving the wiper 32A and the wiper 32B in the direction indicated by an arrow in FIG. 2 is performed.

Figure 3:
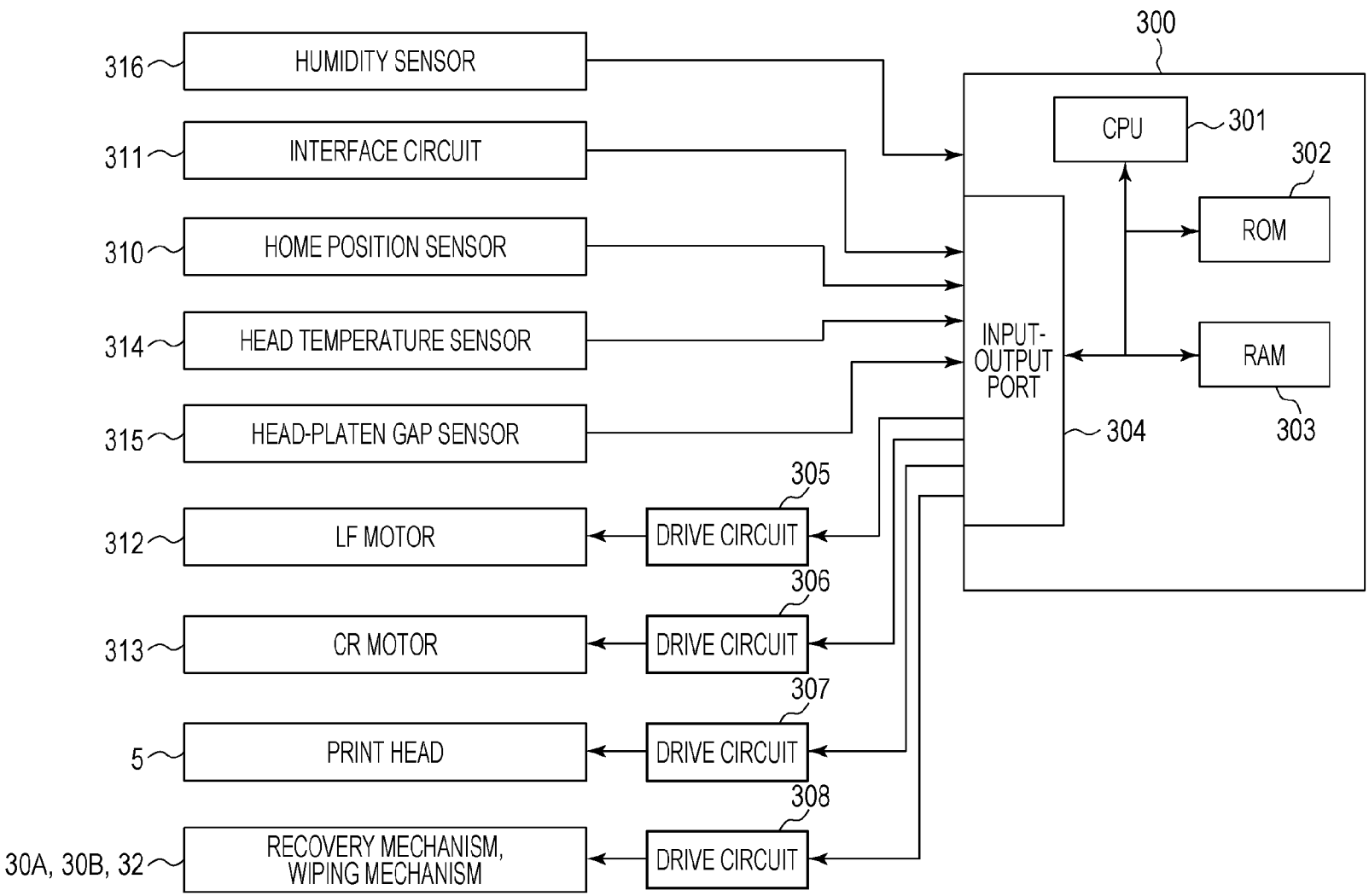
FIG. 3 is a block diagram illustrating the configuration of a control system of the printing apparatus according to the embodiment of the present invention.

FIG. 3 is a block diagram illustrating the configuration of a control system of the printing apparatus according to this embodiment. Reference sign 300 denotes a main controller serving as a controller and a print-head driver. The main controller 300 includes, for example, a central processing unit (CPU) 301, a read-only memory (ROM) 302, a random access memory (RAM) 303, and an input-output port 304. The CPU 301 executes predetermined processes, such as an arithmetic process, a control process, a determination process, and a setting process. The ROM 302 stores a control program to be executed by the CPU 301 as well as other fixed data. Specifically, the ROM 302 stores, for example, tables to be described later. The RAM 303 has, for example, a buffer area for data to be printed and an area to be used as a work area during a process executed by the CPU 301. Specifically, the RAM 303 has, for example, an area to be used as a counter for counting the printing amount (i.e., the number of sheets of printing media and the number of ink discharges for printing) in a process to be described later.

The input-output port 304 is connected to a drive circuit 305 for a low-frequency (LF) motor 312 for driving a conveying system and also to a drive circuit 306 for a compression-ratio (CR) motor 313 for moving the carriage 1. The input-output port 304 is also connected to a drive circuit 307 for driving the nozzles of the discharge portions of the print head 5. Moreover, the input-output port 304 is connected to a drive circuit 308 for driving the recovery mechanisms 30A and 30B and the wiping mechanism 32. The input-output port 304 is also connected to a home position sensor 310, a head temperature sensor 314, a gap sensor 315, and an interface circuit 311. The home position sensor 310 is used for detecting a reference position used for controlling the movement of the carriage 1 and the print head 5. The print head 5 is set relative to the recovery mechanisms 30A and 30B and the wiping mechanism 32 based on the detection result of this home position sensor 310. The gap sensor 315 is used for detecting the distance between the print head 5 and a platen. The interface circuit 311 is used for exchanging predetermined information with an external apparatus (e.g., a computer that may be an image scanner, a digital camera, or of another appropriate type) serving as a supply source for data to be printed. Reference sign 316 denotes a humidity sensor provided at an appropriate location. The humidity sensor 316 is used for detecting the humidity in the environment in which the printing apparatus body 2 is used.

First Embodiment

Figure 4:
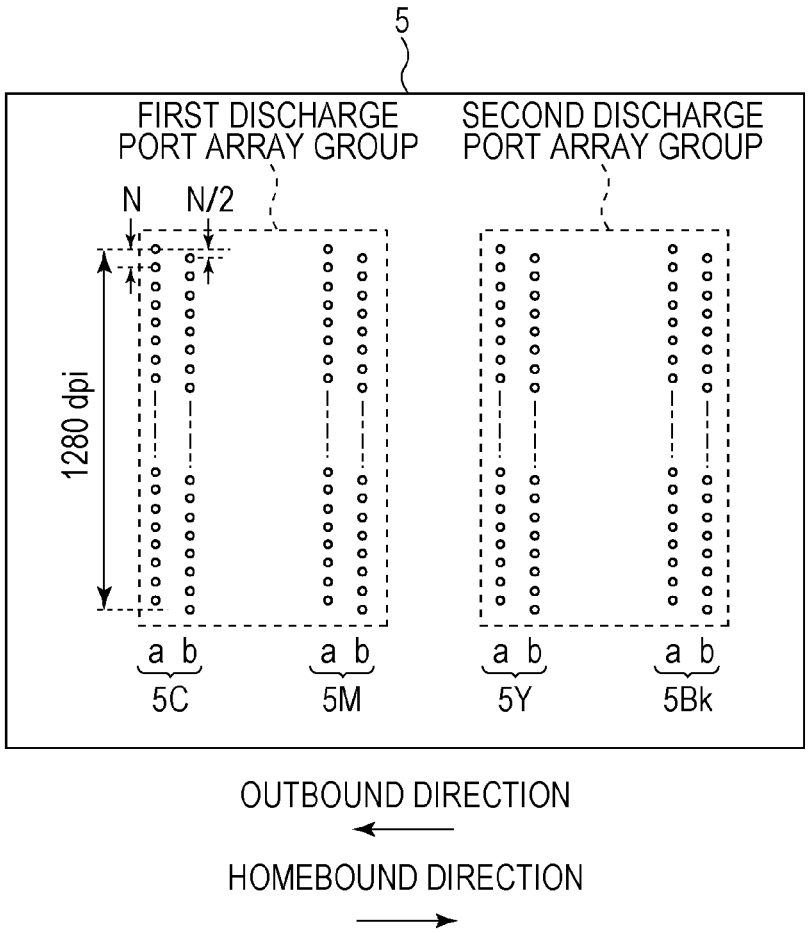
FIG. 4 schematically illustrates the configuration of a print head according to a first embodiment and the relationships among discharge port array groups.

FIG. 4 schematically illustrates the configuration of a print head 5 according to a first embodiment and the relationships among discharge port array groups. The configuration of the print head 5 is similar to that shown in FIG. 2. In the first embodiment, the discharge portions 5C and 5M surrounded by a dotted line in FIG. 4 will be defined as a first discharge port array group, and the discharge portions 5Y and 5Bk surrounded by another dotted line will be defined as a second discharge port array group. A wiping-operation control procedure in this case will be described below.

Figure 5:
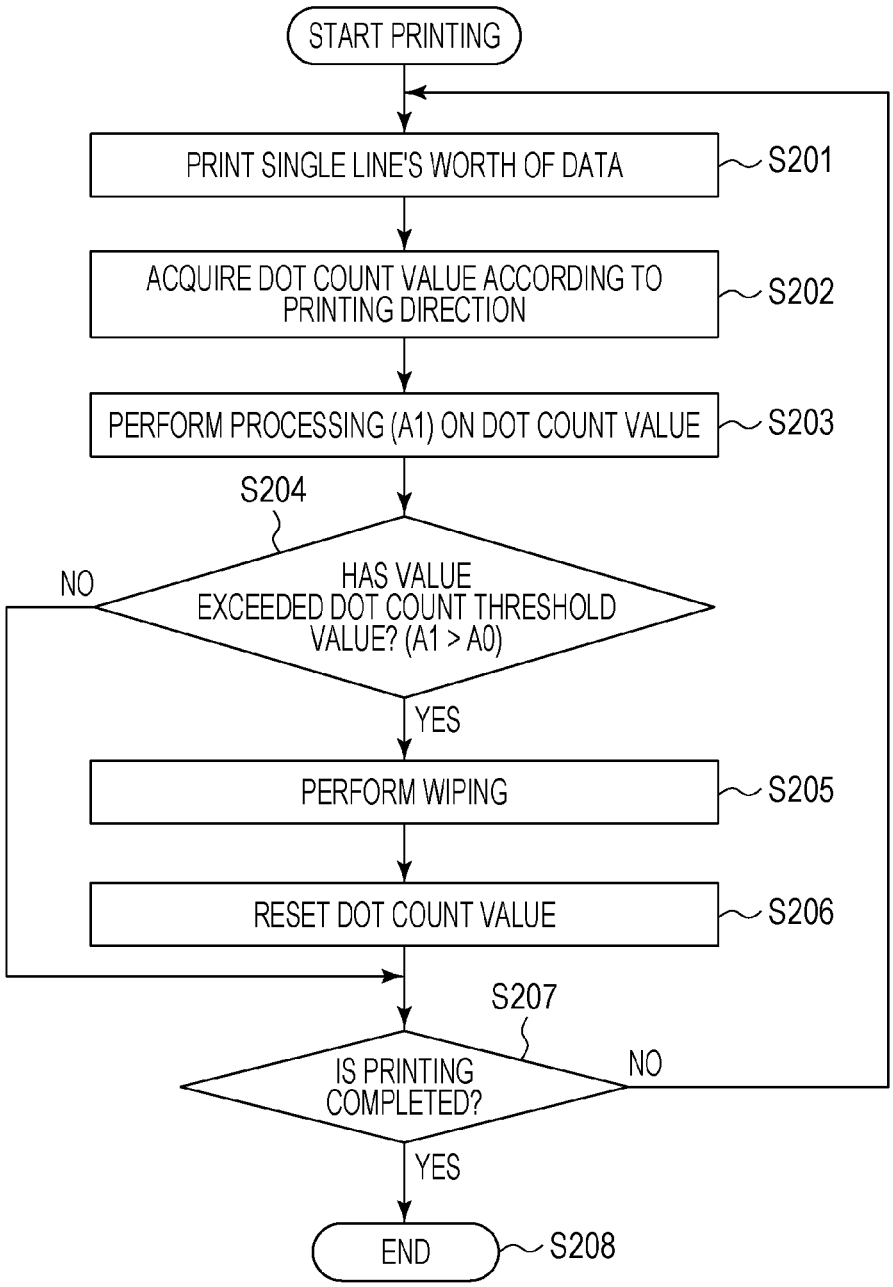
FIG. 5 is a flowchart illustrating a wiping-operation control procedure.

FIG. 5 is a flowchart illustrating the wiping-operation control procedure according to this exemplary embodiment. When a wiping operation is to be performed at every predetermined unit, such as at the end of printing performed on one sheet of printing medium (i.e., printing performed on one page), a problem may occur in that the print productivity may decrease due to intervention of the wiping operation that requires a predetermined period of time or that the durability life of the wipers 32A and 32B may decrease. Thus, a wiping operation is performed according to need. It is desirable to determine whether or not a wiping operation is necessary after printing performed on every page in accordance with the amount of mist that may adhere to the discharge port surface of the print head 5. The amount of mist adhering to the discharge port surface of the print head 5 largely depends on the ink discharge amount or the number of times ink is discharged.

In this embodiment, a dot count value is obtained for each discharge port array group by counting (dot-counting) the number of ink discharges for printing after the previous wiping operation. Then, each dot count value is multiplied by a predetermined coefficient according to the moving direction of the print head 5, and a wiping operation is performed if the total value is larger than or equal to a predetermined threshold value.

Referring to FIG. 5, in step S201, a single line's worth of print data is printed. In step S202, the number of times ink is discharged in accordance with the print data is integrated so that a dot count value is acquired. In step S203, the dot count value acquired in step S202 is multiplied by a predetermined coefficient according to the moving direction of the print head 5 based on a table shown in FIG. 6A. For example, with respect to the order of arrangement of the discharge port array groups shown in FIG. 4, the first discharge port array group (5C and 5M) acts as the front discharge port array group in the moving direction (outbound direction) during outbound printing (leftward in FIG. 4) and is thus strongly affected by the inflow air current. Therefore, the amount of discharged ink is multiplied by a first coefficient (=5). The second discharge port array group (5Y and 5Bk) acts as the rear discharge port array group and is less affected by the inflow air current than the front discharge port array group. Therefore, the amount of discharged ink is multiplied by a second coefficient (=1), which is smaller than the first coefficient.

In contrast, during homebound printing, the second discharge port array group (5Y and 5Bk) acts as the front discharge port array group in the moving direction, whereas the first discharge port array group (5C and 5M) acts as the rear discharge port array group. Thus, the effect of inflow air current occurring with the movement of the print head 5 is inverted relative to that during outbound printing. The coefficient applied to the second discharge port array group becomes the first coefficient (=5), and the coefficient applied to the first discharge port array group becomes the second coefficient (=1). The coefficients to be multiplied by the ink consumption amounts are arbitrary numerical values used for providing an easier understanding of the contents of the embodiment and are not limited to these values. The same applies to subsequent embodiments. Based on the above concept, the calculation expressions used for processing the dot count values (discharge amounts) in outbound printing and homebound printing are as follows.

(Calculation Expression for Outbound Printing)=Ink Discharge Amount of Front Discharge Port Array Group (First Discharge Port Array Group) in Moving Direction×First Coefficient (=5)

+Ink Discharge Amount of Rear Discharge Port Array Group (Second Discharge Port Array Group) in Moving Direction×Second Coefficient (=1)

(Calculation Expression for Homebound Printing) =Ink Discharge Amount of Front Discharge Port Array Group (Second Discharge Port Array Group) in Moving Direction×First Coefficient (=5)

+Ink Discharge Amount of Rear Discharge Port Array Group (First Discharge Port Array Group) in Moving Direction×Second Coefficient (=1)

In the above expressions, each ink discharge amount is calculated by multiplying the amount of ink discharged per single discharge by a dot count value. Each ink discharge amount is a given value determined from, for example, the ink used and the configuration of the head (particularly, nozzles). Subsequently, in step S204, it is determined whether or not each of the values processed based on the above calculation expressions is larger than or equal to a predetermined threshold value. If it is determined that the value is larger than or equal to the predetermined threshold value, a wiping operation is executed in step S205. Then, in step S206, the dot count value is reset. The process then proceeds to step S207 where it is determined whether or not the printing operation is completed. If it is determined that the printing operation is not completed, the process returns to step S201 to print the next single line's worth of print data.

In contrast, if it is determined that the printing operation is completed, the process proceeds to step S208 to end the procedure. Furthermore, if it is determined in step S204 that the value is smaller than the predetermined threshold value, the process proceeds to step S207. In step S207, it is similarly determined whether or not the printing operation is completed. If it is determined that the printing operation is not completed, the process returns to step S201 to print the next single line's worth of print data. If it is determined that the printing operation is completed, the process proceeds to step S208 to end the procedure.

Figure 7A:
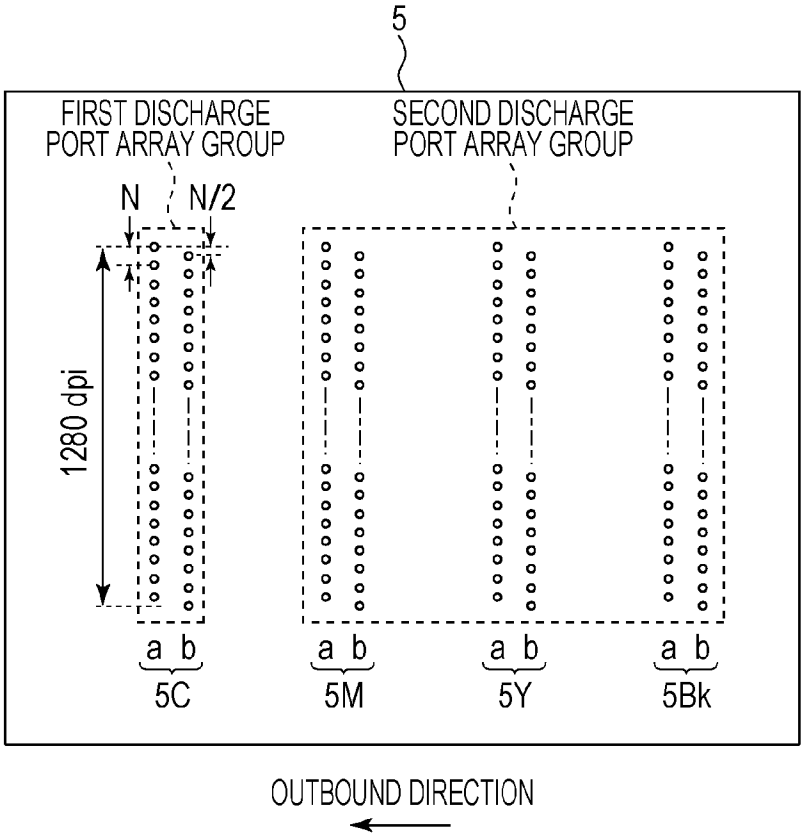
FIGS. 7A and 7B schematically illustrate the configuration of a print head according to a modification of the first embodiment and the relationships among discharge port array groups.
Figure 7B:
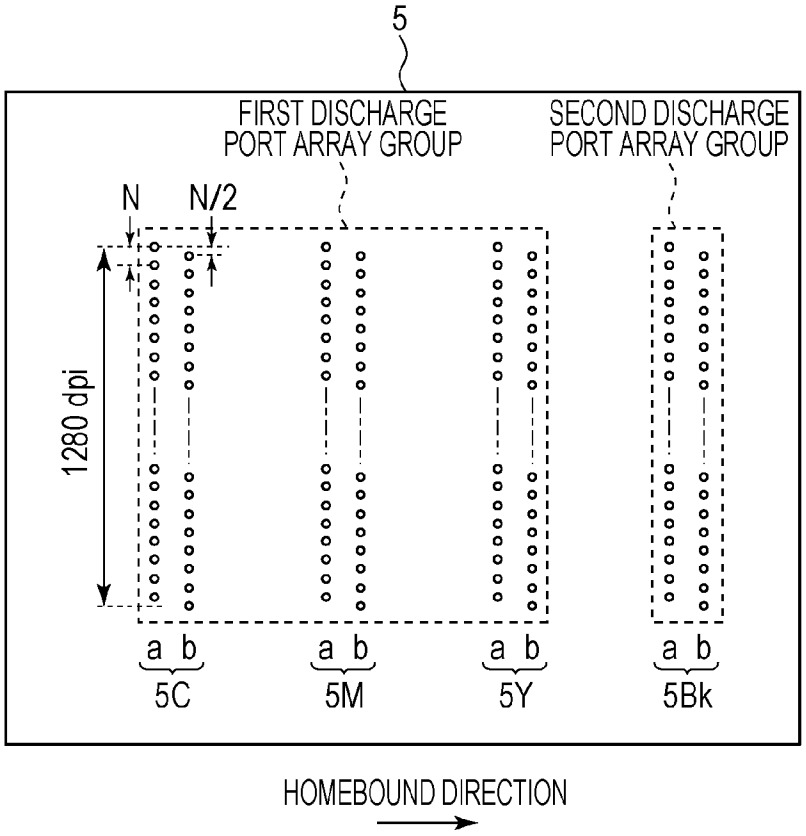

Accordingly, a dot count value of each discharge port array group is multiplied by a coefficient according to the moving direction of the print head 5 so that the discharge port surface of the print head 5 can be cleaned off in accordance with the amount of mist adhered to the discharge port surface. Consequently, deterioration of image quality caused by, for example, a discharge defect or color mixing occurring due to adhesion of floating mist on the discharge port surface can be reliably prevented. Modification of First Embodiment FIGS. 7A and 7B illustrate a modification of the discharge port array groups shown in FIG. 4. FIG. 7A illustrates a case where the discharge portion 5C is defined as the first discharge port array group and the discharge portions 5M, 5Y, and 5Bk are defined as the second discharge port array group, and FIG. 7B illustrates a case where the discharge portions 5C, 5M, and 5Y are defined as the first discharge port array group and the discharge portion 5Bk is defined as the second discharge port array group. Because the front discharge port array is the most affected by the inflow air current when the print head 5 moves, the front discharge port array when the print head 5 moves is set as a single discharge port array group, and a large coefficient is applied to the front discharge port array group. For example, the discharge portion 5C is defined as the first discharge port array group for outbound printing, as shown in FIG. 7A, and the discharge portion 5Bk is defined as the second discharge port array group for homebound printing, as shown in FIG. 7B.

During outbound printing (leftward in FIG. 7A), the first discharge port array group (5C) acts as the front discharge port array group in the moving direction and is thus largely affected by the inflow air current. Therefore, the amount of discharged ink is multiplied by the first coefficient (=5). The second discharge port array group (5M, 5Y, and 5Bk) acts as the rear discharge port array group and is less affected by the inflow air current than the front discharge port array group. Therefore, the amount of discharged ink is multiplied by the second coefficient (=1), which is smaller than the first coefficient.

In contrast, during homebound printing, the second discharge port array group (5Bk) acts as the front discharge port array group in the moving direction, whereas the first discharge port array group (5C, 5M, and 5Y) acts as the rear discharge port array group. Thus, the effect of inflow air current occurring with the movement of the print head 5 is inverted relative to that during outbound printing. The coefficient applied to the second discharge port array group becomes the first coefficient (=5), and the coefficient applied to the first discharge port array group becomes the second coefficient (=1). Accordingly, the manner in which the discharge port array groups are defined is not limited to a single manner.

Second Embodiment

Figure 8:
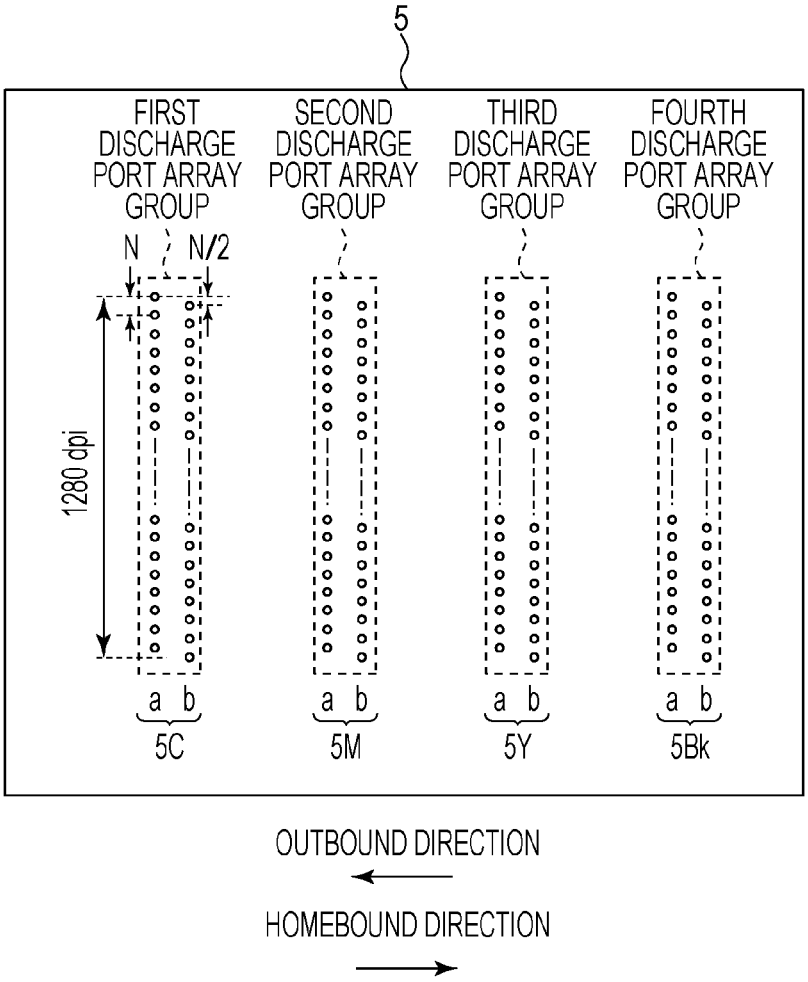
FIG. 8 schematically illustrates the configuration of a print head according to a second embodiment and the relationships among discharge port array groups.

FIG. 8 schematically illustrates the configuration of a print head 5 according to a second embodiment and the relationships among discharge port array groups. The configuration of the print head 5 is similar to that shown in FIG. 2. In the second embodiment, the discharge portions 5C, 5M, 5Y, and 5Bk surrounded by respective dotted lines in FIG. 8 are defined as a first discharge port array group, a second discharge port array group, a third discharge port array group, and a fourth discharge port array group, respectively. A wiping-operation control procedure in this case will be described below. Similar to the first embodiment, wiping-operation control is performed based on the flowchart in FIG. 5. In this embodiment, predetermined coefficients are applied in accordance with the moving direction of the print head 5 based on a table shown in FIG. 6B.

The following description with reference to FIG. 8 relates to an example where the effect of inflow air current weakens in a stepwise manner from the front side toward the rear side in the moving direction when the print head 5 moves. During outbound printing (leftward in FIG. 8), the amount of ink discharged from the first discharge port array group (5C) is multiplied by a first coefficient (=5), and the amount of ink discharged from the second discharge port array group (5M) is multiplied by a second coefficient (=3). The amount of ink discharged from the third discharge port array group (5Y) is multiplied by a third coefficient (=2), and the amount of ink discharged from the fourth discharge port array group (5Bk) is multiplied by a fourth coefficient (=1).

In contrast, during homebound printing (rightward in FIG. 8), the fourth discharge port array group (5Bk) acts as the front discharge port array group in the moving direction. Thus, the effect of inflow air current occurring with the movement of the print head 5 is inverted relative to that during outbound printing. The amount of ink discharged from the fourth discharge port array group (5Bk) is multiplied by the first coefficient (=5), and the amount of ink discharged from the third discharge port array group (5Y) is multiplied by the second coefficient (=3). The amount of ink discharged from the second discharge port array group (5M) is multiplied by the third coefficient (=2), and the amount of ink discharged from the first discharge port array group (5C) is multiplied by the fourth coefficient (=1). Subsequently, wiping-operation control is performed similarly to that in the first embodiment.

By setting a discharge port array group for each color as in this embodiment, a coefficient set in view of the effect of inflow air current is applied to each ink discharge port array, thereby allowing for finer control than in the first embodiment.

Third Embodiment

Figure 9:
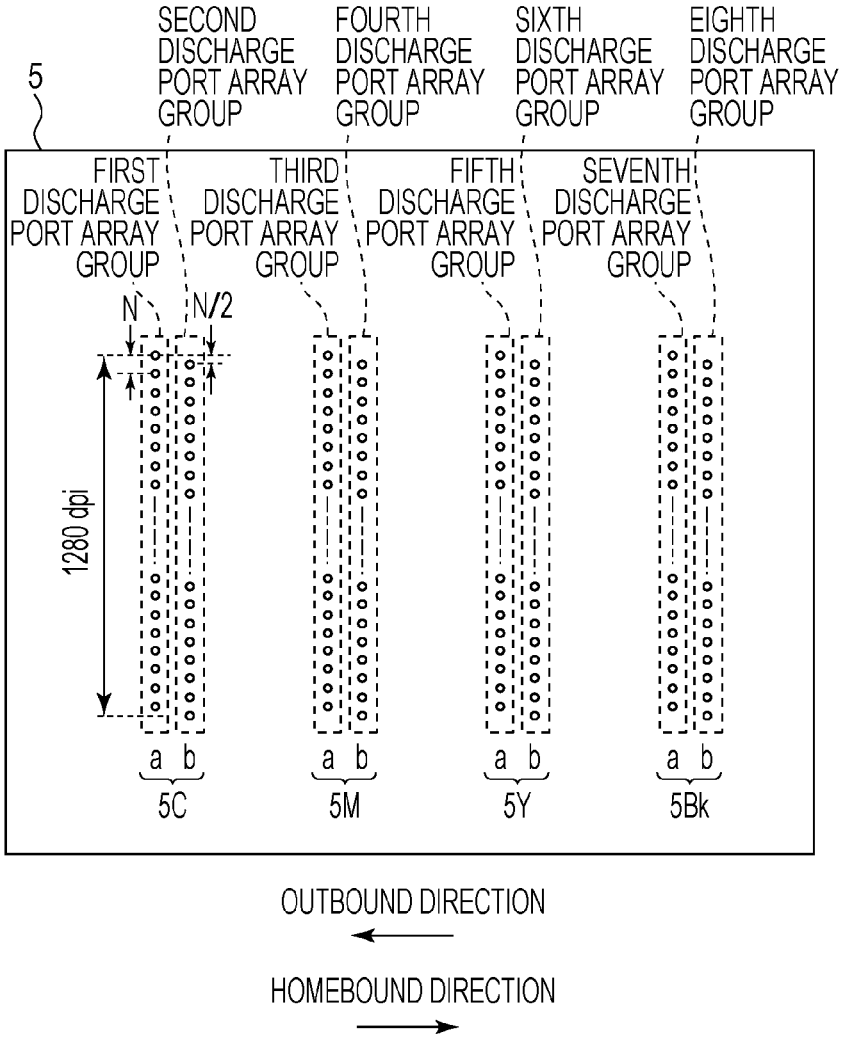
FIG. 9 schematically illustrates the configuration of a print head according to a third embodiment and the relationships among discharge port array groups.

FIG. 9 schematically illustrates the configuration of a print head 5 according to a third embodiment and the relationships among discharge port array groups. The configuration of the print head 5 is similar to that shown in FIG. 2. In the third embodiment, the arrays for each color surrounded by respective dotted lines (arrays a and b in FIG. 9) are defined as individual discharge port array groups. Accordingly, a single discharge port array may be designated as a discharge port array group, meaning that each discharge port array group does not necessarily have to include two or more discharge port arrays. A wiping-operation control procedure in this case will be described below.

Similar to the first embodiment, wiping-operation control is performed based on the flowchart in FIG. 5. In this embodiment, predetermined coefficients are applied in accordance with the moving direction of the print head 5 based on a table shown in FIG. 6C.

Similar to the second embodiment, the following description with reference to FIG. 9 relates to an example where the effect of inflow air current weakens in a stepwise manner from the front side toward the rear side in the moving direction when the print head 5 moves. During outbound printing (leftward in FIG. 9), the amount of ink discharged from the first discharge port array group (array a of 5C) is multiplied by a first coefficient (=5), the amount of ink discharged from the second discharge port array group (array b of 5C) is multiplied by a second coefficient (=3), the amount of ink discharged from the third discharge port array group (array a of 5M) is multiplied by a third coefficient (=3), the amount of ink discharged from the fourth discharge port array group (array b of 5M) is multiplied by a fourth coefficient (=2), and so on. Likewise, the amounts of ink discharged from the subsequent discharge port array groups are multiplied by predetermined coefficients, up to the eighth discharge port array group (array b of 5Bk).

In contrast, during homebound printing (rightward in FIG. 9), the eighth discharge port array group (array b of 5Bk) acts as the front discharge port array group in the moving direction. Thus, the effect of inflow air current occurring with the movement of the print head 5 is inverted relative to that during outbound printing. The amount of ink discharged from the eighth discharge port array group (array b of 5Bk) is multiplied by the first coefficient (=5), the amount of ink discharged from the seventh discharge port array group (array a of 5Bk) is multiplied by the second coefficient (=3), the amount of ink discharged from the sixth discharge port array group (array b of 5Y) is multiplied by the third coefficient (=3), the amount of ink discharged from the fifth discharge port array group (array a of 5Y) is multiplied by the fourth coefficient (=2), and so on. Likewise, the amounts of ink discharged from the subsequent discharge port array groups are multiplied by predetermined coefficients, up to the first discharge port array group (array a of 5C). Subsequently, wiping-operation control is performed similarly to that in the first embodiment.

According to this embodiment, the arrays for each color are defined as individual discharge port array groups, so that a coefficient set in view of the effect of inflow air current is applied to each ink discharge port array, thereby allowing for finer control than in the first and second embodiments.

Fourth Embodiment

Figure 10:
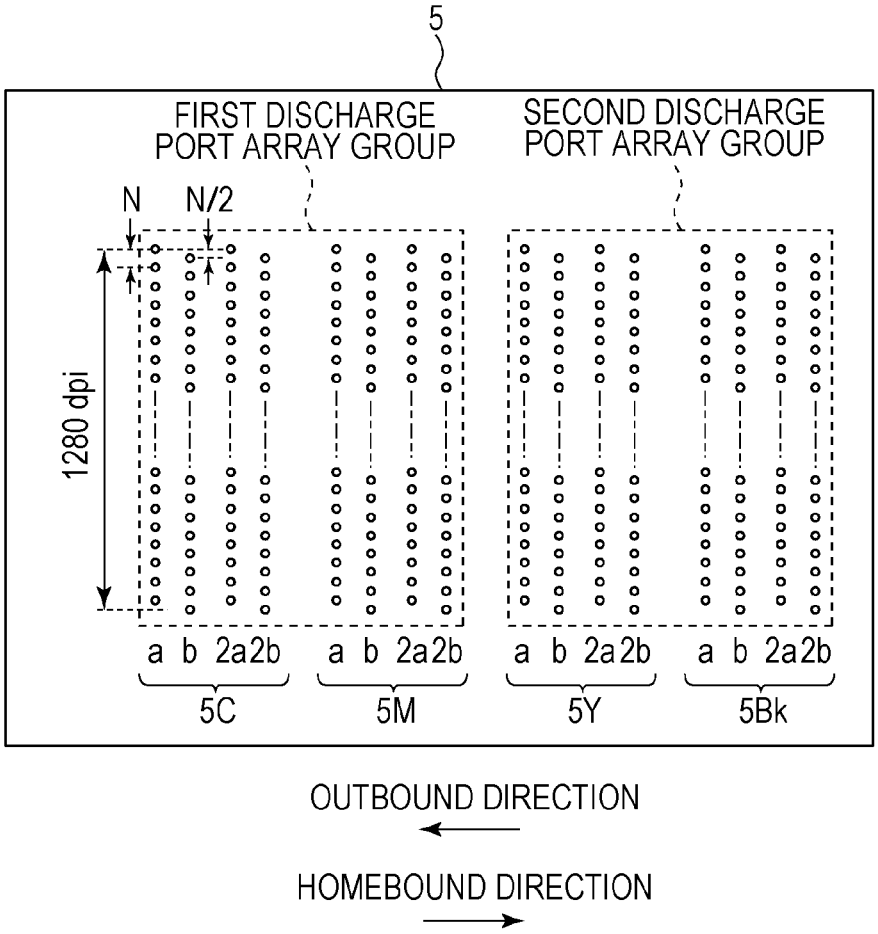
FIG. 10 schematically illustrates the configuration of a print head according to a fourth embodiment and the relationships among discharge port array groups.

FIG. 10 schematically illustrates the configuration of a print head 5 according to a fourth embodiment and the relationships among discharge port array groups. In this embodiment, the print head 5 has discharge portions 5C, 5M, 5Y, and 5Bk that respectively correspond to C, M, Y, and Bk inks. Each color is provided with two sets of parallel-arranged discharge port arrays a and b shown in FIG. 2. In this configuration, the density of nozzle arrays for each color in the moving direction is twice as large as that in the configuration of the print head 5 in FIG. 2, thereby allowing for ink discharging with higher frequency. A wiping-operation control procedure in this configuration will be described below.

In the fourth embodiment, the discharge portions 5C and 5M and the discharge portions 5Y and 5Bk surrounded by respective dotted lines in FIG. 10 are defined as a first discharge port array group and a second discharge port array group, respectively. A wiping-operation control procedure in this case will be described below.

Similar to the first embodiment, wiping-operation control is performed based on the flowchart in FIG. 5. In this embodiment, predetermined coefficients are applied in accordance with the moving direction of the print head 5 based on the table shown in FIG. 6A.

The control procedure will be described with reference to the configuration of the print head 5 and the relationships among the discharge port arrays shown in FIG. 10 as an example. During outbound printing (leftward in FIG. 10), the first discharge port array group (5C and 5M) acts as the front discharge port array group in the moving direction and is thus strongly affected by the inflow air current. Therefore, the amount of discharged ink is multiplied by the first coefficient (=5). The second discharge port array group (5Y and 5Bk) acts as the rear discharge port array group and is less affected by the inflow air current. Therefore, the amount of discharged ink is multiplied by the second coefficient (=1), which is smaller than the first coefficient.

In contrast, during homebound printing, the second discharge port array group (5Y and 5Bk) acts as the front discharge port array group in the moving direction, whereas the first discharge port array group (5C and 5M) acts as the rear discharge port array group. Thus, the effect of inflow air current occurring with the movement of the print head 5 is inverted relative to that during outbound printing. The coefficient applied to the second discharge port array group becomes the first coefficient (=5), and the coefficient applied to the first discharge port array group becomes the second coefficient (=1). Subsequently, wiping-operation control is performed similarly to that in the first embodiment.

Modification of Fourth Embodiment

Figure 11A:
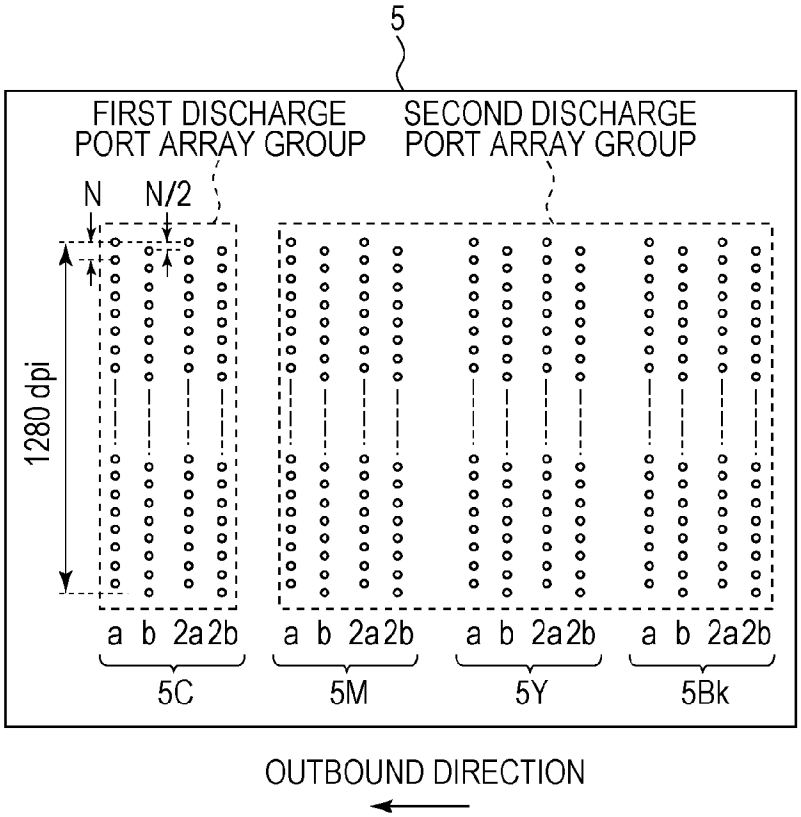
FIGS. 11A and 11B schematically illustrate the configuration of a print head according to a modification of the fourth embodiment and the relationships among discharge port array groups.
Figure 11B:
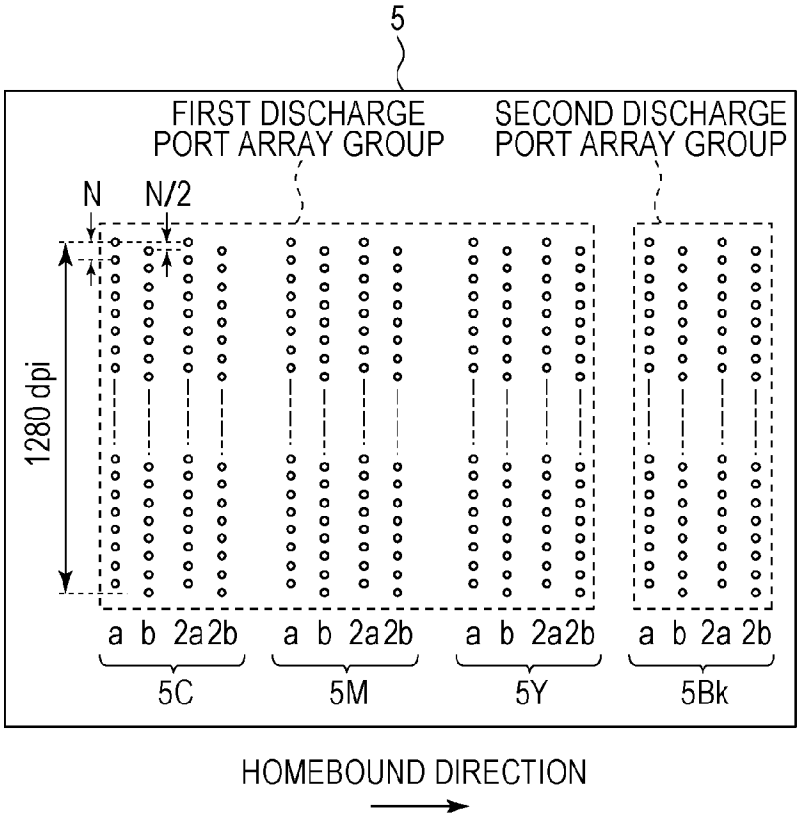

FIGS. 11A and 11B illustrate a modification of the discharge port array groups shown in FIG. 10. FIG. 11A illustrates a case where the discharge portion 5C is defined as the first discharge port array group and the discharge portions 5M, 5Y, and 5Bk are defined as the second discharge port array group. FIG. 11B illustrates a case where the discharge portions 5C, 5M, and 5Y are defined as the first discharge port array group and the discharge portion 5Bk is defined as the second discharge port array group. Similar to the modification of the first embodiment, because the front discharge port array is the most affected by the inflow air current when the print head 5 moves, the front discharge port array when the print head 5 moves may be set as a single discharge port array group. For example, the discharge portion 5C is defined as the first discharge port array group for outbound printing, as shown in FIG. 11A, and the discharge portion 5Bk is defined as the second discharge port array group for homebound printing, as shown in FIG. 11B. Accordingly, this embodiment is similar to the first embodiment in that the manner in which the discharge port array groups are defined is not limited to a single manner, and the discharge port arrays may be changed in accordance with the moving direction. Subsequently, wiping-operation control is performed similarly to that in the first embodiment.

Fifth Embodiment

Figure 12:
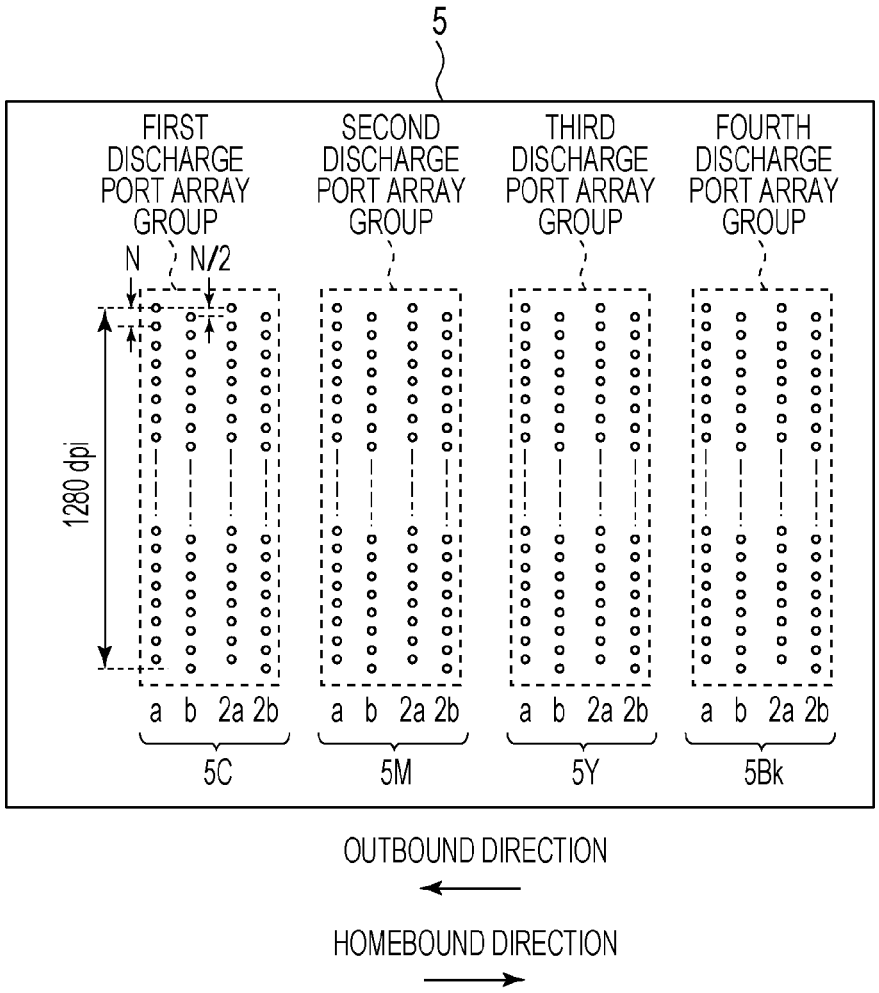
FIG. 12 schematically illustrates the configuration of a print head according to a fifth embodiment and the relationships among discharge port array groups.

FIG. 12 schematically illustrates the configuration of a print head 5 according to a fifth embodiment and the relationships among discharge port array groups. The configuration of the print head 5 is similar to that shown in FIG. 10. In the fifth embodiment, the discharge portions 5C, 5M, 5Y, and 5Bk surrounded by respective dotted lines in FIG. 12 are defined as a first discharge port array group, a second discharge port array group, a third discharge port array group, and a fourth discharge port array group, respectively. A wiping-operation control procedure in this case will be described below.

Similar to the first embodiment, wiping-operation control in this embodiment is performed based on the flowchart in FIG. 5. In this embodiment, predetermined coefficients are applied in accordance with the moving direction of the print head 5 based on the table shown in FIG. 6B.

The control procedure will be described with reference to the configuration of the print head 5 and the relationships among the discharge port arrays shown in FIG. 12 as an example. The following description relates to an example where the effect of inflow air current weakens in a stepwise manner from the front side toward the rear side in the moving direction when the print head 5 moves. For example, during outbound printing (leftward in FIG. 12), the amount of ink discharged from the first discharge port array group (5C) is multiplied by the first coefficient (=5), and the amount of ink discharged from the second discharge port array group (5M) is multiplied by the second coefficient (=3). The amount of ink discharged from the third discharge port array group (5Y) is multiplied by the third coefficient (=2), and the amount of ink discharged from the fourth discharge port array group (5Bk) is multiplied by the fourth coefficient (=1).

In contrast, during homebound printing, the fourth discharge port array group (5Bk) acts as the front discharge port array group in the moving direction. Thus, the effect of inflow air current occurring with the movement of the print head 5 is inverted relative to that during outbound printing. The amount of ink discharged from the fourth discharge port array group (5Bk) is multiplied by the first coefficient (=5), and the amount of ink discharged from the third discharge port array group (5Y) is multiplied by the second coefficient (=3). The amount of ink discharged from the second discharge port array group (5M) is multiplied by the third coefficient (=2), and the amount of ink discharged from the first discharge port array group (5C) is multiplied by the fourth coefficient (=1). Subsequently, wiping-operation control is performed similarly to that in the first embodiment.

By setting a discharge port array group for each color as in this embodiment, a coefficient set in view of the effect of inflow air current is applied to each ink discharge port array, thereby allowing for finer control than in the fourth embodiment.

Sixth Embodiment

Figure 13:
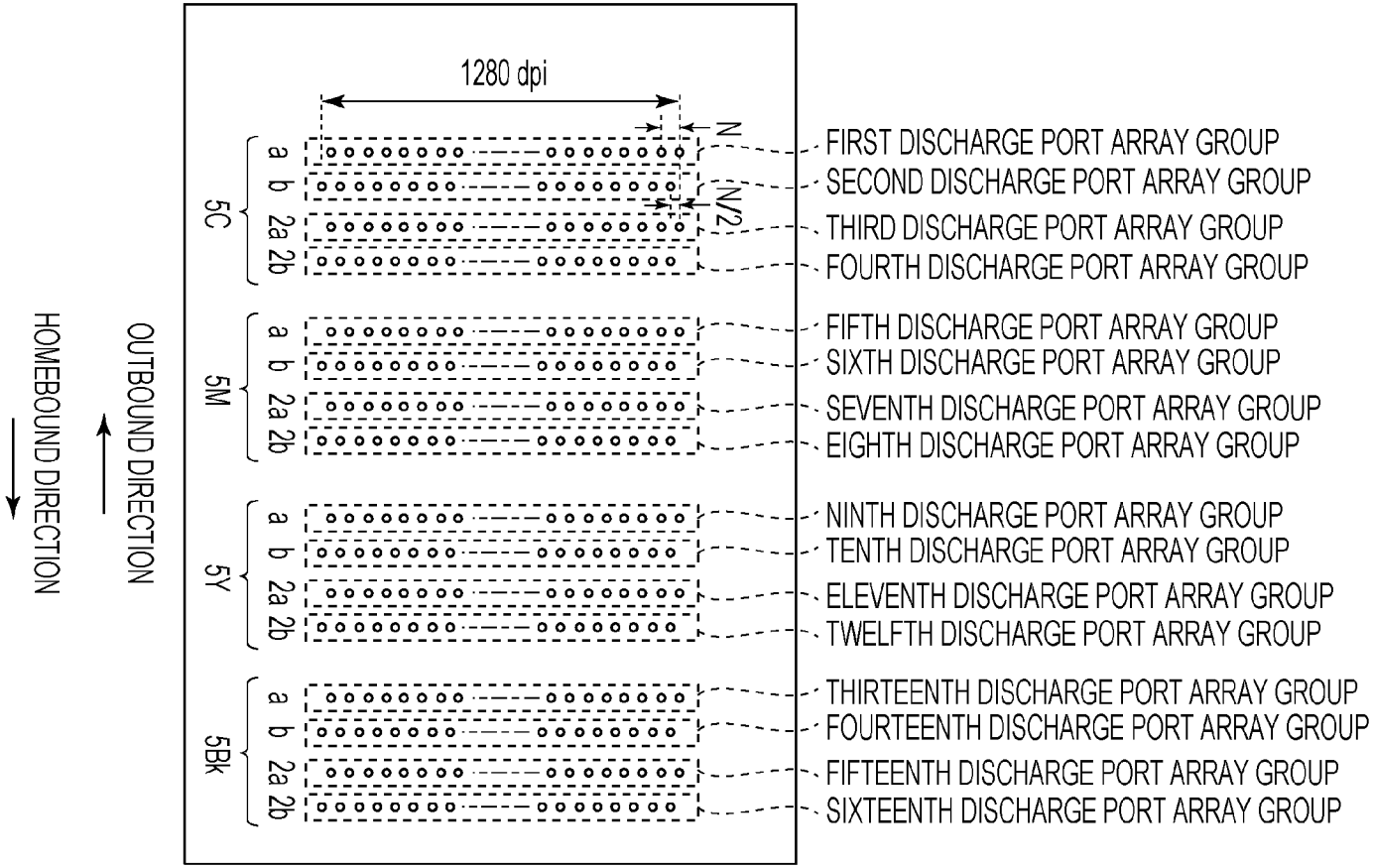
FIG. 13 schematically illustrates the configuration of a print head according to a sixth embodiment and the relationships among discharge port array groups.

FIG. 13 schematically illustrates the configuration of a print head 5 according to a sixth embodiment and the relationships among discharge port array groups. The configuration of the print head 5 is similar to that shown in FIG. 10. In the sixth embodiment, the arrays (a, b, 2*a*, and 2*b*) for each color surrounded by respective dotted lines in FIG. 13 are defined as individual discharge port array groups. Accordingly, similar to the third embodiment, a single discharge port array may be designated as a discharge port array group, meaning that each discharge port array group does not necessarily have to include two or more discharge port arrays. A wiping-operation control procedure in this case will be described below.

Similar to the first embodiment, wiping-operation control is performed based on the flowchart in FIG. 5. In this embodiment, predetermined coefficients are applied in accordance with the moving direction of the print head 5 based on a table shown in FIG. 14. The control procedure will be described with reference to the configuration of the print head 5 and the relationships among the discharge port arrays shown in FIG. 13 as an example. The following description relates to an example where the effect of inflow air current weakens in a stepwise manner from the front side toward the rear side in the moving direction when the print head 5 moves. For example, during outbound printing (leftward in FIG. 13), the amount of ink discharged from the first discharge port array group (array a of 5C) is multiplied by a first coefficient (=5), the amount of ink discharged from the second discharge port array group (array b of 5C) is multiplied by a second coefficient (=5), the amount of ink discharged from the third discharge port array group (array 2*a* of 5C) is multiplied by a third coefficient (=3), the amount of ink discharged from the fourth discharge port array group (array 2*b* of 5C) is multiplied by a fourth coefficient (=3), and so on. Likewise, the amounts of ink discharged from the subsequent discharge port array groups are multiplied by predetermined coefficients, up to the sixteenth discharge port array group (array 2*b* of 5Bk).

In contrast, during homebound printing, the sixteenth discharge port array group (array 2*b* of 5Bk) acts as the front discharge port array group in the moving direction. Thus, the effect of inflow air current occurring with the movement of the print head 5 is inverted relative to that during outbound printing. The amount of ink discharged from the sixteenth discharge port array group (array 2*b* of 5Bk) is multiplied by the first coefficient (=5), the amount of ink discharged from the fifteenth discharge port array group (array 2*a* of 5Bk) is multiplied by the second coefficient (=5), the amount of ink discharged from the fourteenth discharge port array group (array b of 5Bk) is multiplied by the third coefficient (=3), the amount of ink discharged from the thirteenth discharge port array group (array a of 5Bk) is multiplied by the fourth coefficient (=3), and so on. Likewise, the amounts of ink discharged from the subsequent discharge port array groups are multiplied by predetermined coefficients, up to the first discharge port array group (array a of 5C). Subsequently, wiping-operation control is performed similarly to that in the first embodiment.

According to this embodiment, the arrays for each color are defined as individual discharge port array groups, so that a coefficient set in view of the effect of inflow air current is applied to each ink discharge port array, thereby allowing for finer control than in the fourth and fifth embodiments.

Seventh Embodiment

Figure 15:
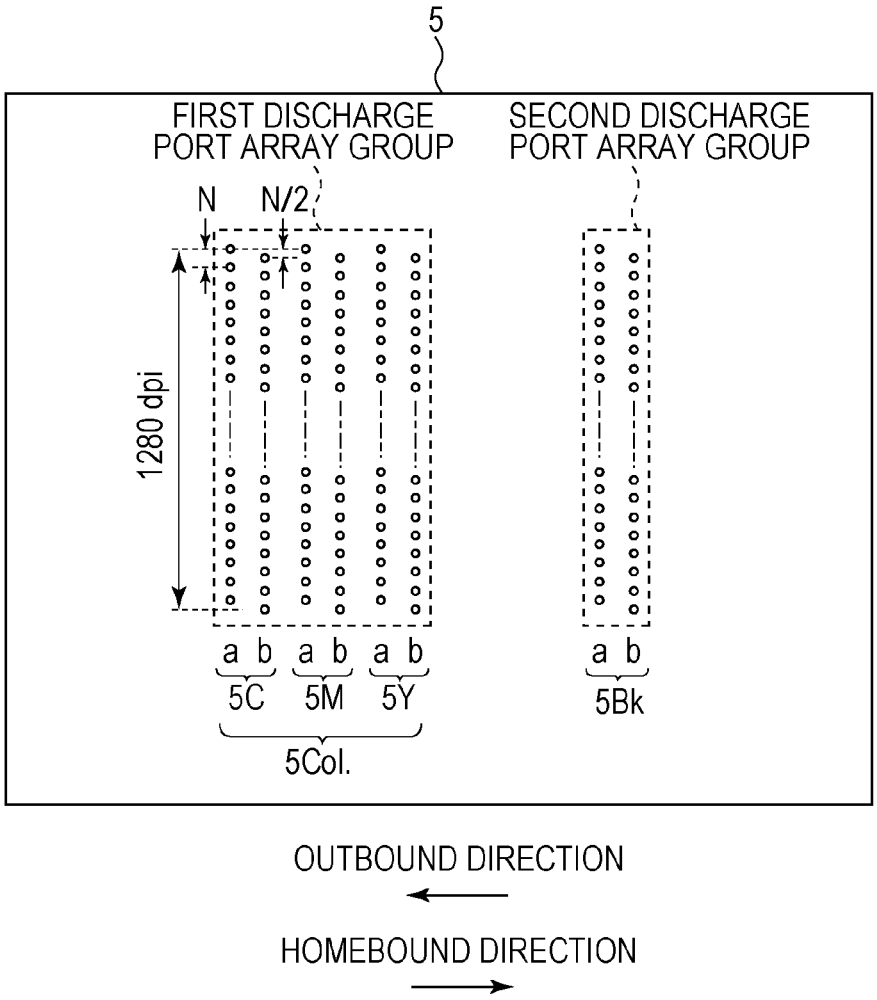
FIG. 15 schematically illustrates the configuration of a print head according to a seventh embodiment and the relationships among discharge port array groups.

FIG. 15 schematically illustrates the configuration of a print head 5 according to a seventh embodiment and the relationships among discharge port array groups. In this embodiment, the print head 5 has a color discharge port array 5Col in which discharge port arrays 5C, 5M, and 5Y respectively corresponding to the C, M, and Y inks are integrated, and also has a black discharge port array 5Bk corresponding to the Bk ink. Each discharge port array has 1,280 discharge ports arranged with a density of 1200 dpi (reference value) in the direction (i.e., vertical direction in FIG. 15) intersecting the moving direction (i.e., horizontal direction in FIG. 15) of the carriage 1 and the print head 5. Furthermore, each discharge port array is constituted of two arrays of discharge ports (arrays a and b in FIG. 15). The array a has 640 discharge ports arranged with a density of 600 dpi at pitch (N) corresponding thereto. The array b has 640 discharge ports arranged in a hounds-tooth check pattern with a density of 600 dpi at positions displaced relative to the array a by half pitch (N/2) in the array direction of the discharge ports.

In the seventh embodiment, the color discharge port array 5Col surrounded by a dotted line in FIG. 15 is defined as a first discharge port array group, and the black discharge port array 5Bk is defined as a second discharge port array group. A wiping-operation control procedure in this case will be described below.

Similar to the first embodiment, wiping-operation control in this embodiment is performed based on the flowchart in FIG. 5. In this embodiment, predetermined coefficients are applied in accordance with the moving direction of the print head 5 based on the table shown in FIG. 6A.

The control procedure will be described with reference to the configuration of the print head 5 and the relationships among the discharge port arrays shown in FIG. 15 as an example. During outbound printing (leftward in FIG. 15), the first discharge port array group (5Col) acts as the front discharge port array group in the moving direction and is thus strongly affected by the inflow air current. Therefore, the amount of discharged ink is multiplied by the first coefficient (=5). The second discharge port array group (5Bk) acts as the rear discharge port array group and is less affected by the inflow air current. Therefore, the amount of discharged ink is multiplied by the second coefficient (=1), which is smaller than the first coefficient.

In contrast, during homebound printing, the second discharge port array group (5Bk) acts as the front discharge port array group in the moving direction, whereas the first discharge port array group (5Col) acts as the rear discharge port array group. Thus, the effect of inflow air current occurring with the movement of the print head 5 is inverted relative to that during outbound printing. The coefficient applied to the second discharge port array group (5Bk) becomes the first coefficient (=5), and the coefficient applied to the first discharge port array group (5Col) becomes the second coefficient (=1). Subsequently, wiping-operation control is performed similarly to that in the first embodiment.

Eighth Embodiment

Figure 16:
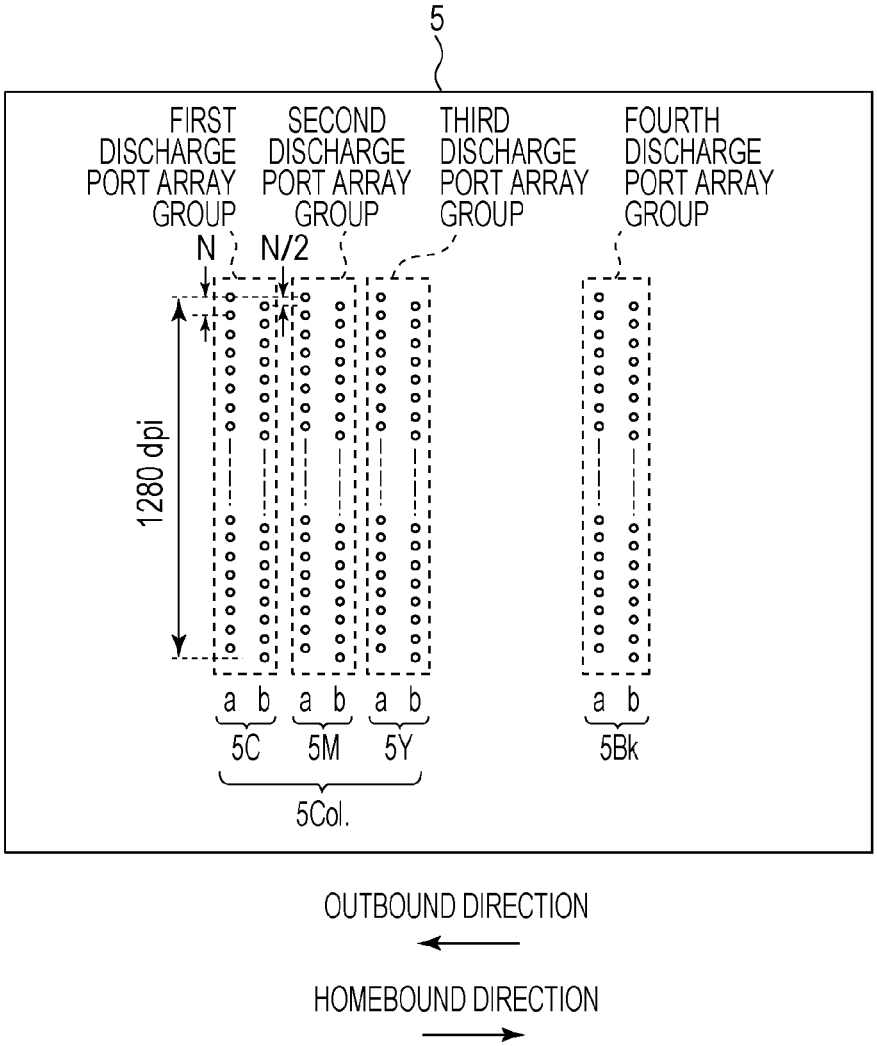
FIG. 16 schematically illustrates the configuration of a print head according to an eighth embodiment and the relationships among discharge port array groups.

FIG. 16 schematically illustrates the configuration of a print head 5 according to an eighth embodiment and the relationships among discharge port array groups. The configuration of the print head 5 is similar to that shown in FIG. 15. In the eighth embodiment, the discharge portions 5C, 5M, 5Y, and 5Bk surrounded by respective dotted lines in FIG. 16 are defined as a first discharge port array group, a second discharge port array group, a third discharge port array group, and a fourth discharge port array group, respectively. A wiping-operation control procedure in this case will be described below.

Similar to the first embodiment, wiping-operation control in this embodiment is performed based on the flowchart in FIG. 5. In this embodiment, predetermined coefficients are applied in accordance with the moving direction of the print head 5 based on the table shown in FIG. 6B.

The control procedure will be described with reference to the configuration of the print head 5 and the relationships among the discharge port arrays shown in FIG. 16 as an example. The following description relates to an example where the effect of inflow air current weakens in a stepwise manner from the front side toward the rear side in the moving direction when the print head 5 moves. For example, during outbound printing (leftward in FIG. 16), the amount of ink discharged from the first discharge port array group (5C) is multiplied by the first coefficient (=5), and the amount of ink discharged from the second discharge port array group (5M) is multiplied by the second coefficient (=3). The amount of ink discharged from the third discharge port array group (5Y) is multiplied by the third coefficient (=2), and the amount of ink discharged from the fourth discharge port array group (5Bk) is multiplied by the fourth coefficient (=1).

In contrast, during homebound printing, the fourth discharge port array group (5Bk) acts as the front discharge port array group in the moving direction. Thus, the effect of inflow air current occurring with the movement of the print head 5 is inverted relative to that during outbound printing. The amount of ink discharged from the fourth discharge port array group (5Bk) is multiplied by the first coefficient (=5), and the amount of ink discharged from the third discharge port array group (5Y) is multiplied by the second coefficient (=3). The amount of ink discharged from the second discharge port array group (5M) is multiplied by the third coefficient (=2), and the amount of ink discharged from the first discharge port array group (5C) is multiplied by the fourth coefficient (=1). Subsequently, wiping-operation control is performed similarly to that in the first embodiment.

By setting a discharge port array group for each color as in this embodiment, a coefficient set in view of the effect of inflow air current is applied to each ink discharge port array, thereby allowing for finer control than in the seventh embodiment.

Ninth Embodiment

Figure 17:
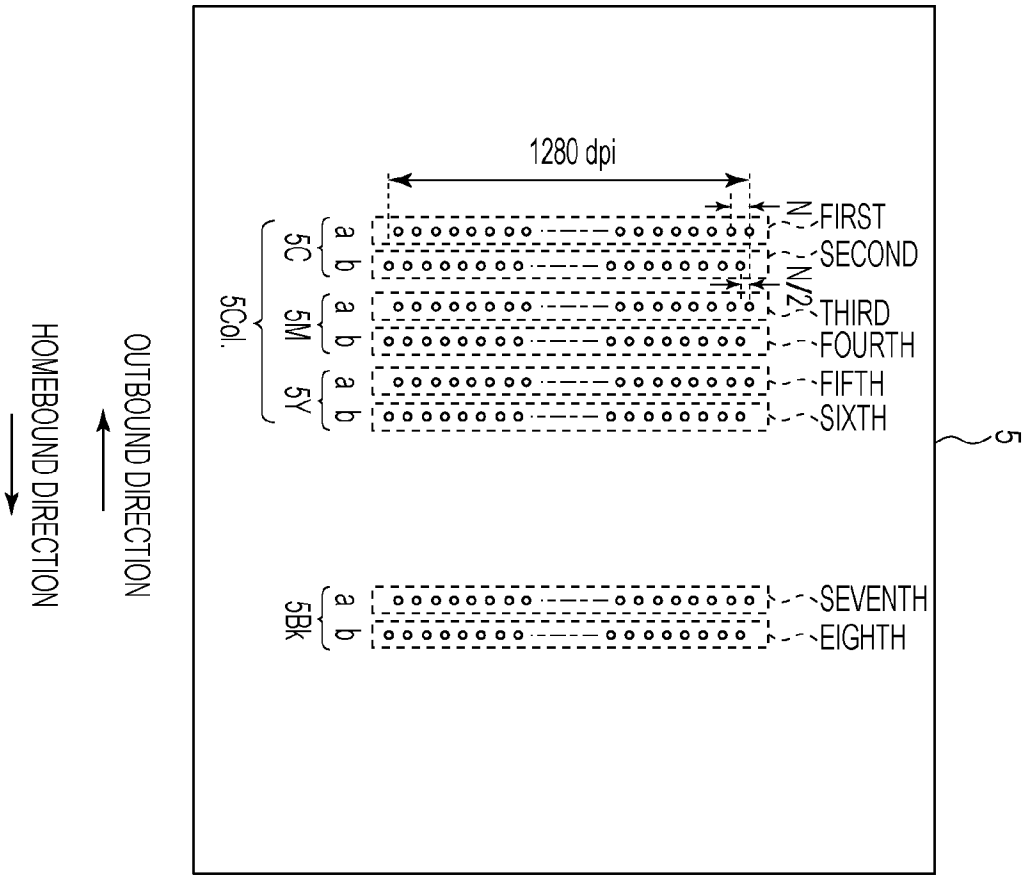
FIG. 17 schematically illustrates the configuration of a print head according to a ninth embodiment and the relationships among discharge port array groups.

FIG. 17 schematically illustrates the configuration of a print head 5 according to a ninth embodiment and the relationships among discharge port array groups. The configuration of the print head 5 is similar to that shown in FIG. 15. In the ninth embodiment, the arrays (a, b) for each color surrounded by respective dotted lines in FIG. 17 are defined as individual discharge port array groups. A wiping-operation control procedure in this case will be described below.

Similar to the first embodiment, wiping-operation control is performed based on the flowchart in FIG. 5. In this embodiment, predetermined coefficients are applied in accordance with the moving direction of the print head 5 based on the table shown in FIG. 6C.

The control procedure will be described with reference to the configuration of the print head 5 and the relationships among the discharge port arrays shown in FIG. 17 as an example. The following description relates to an example where the effect of inflow air current weakens in a stepwise manner from the front side toward the rear side in the moving direction when the print head 5 moves. For example, during outbound printing (leftward in FIG. 17), the amount of ink discharged from the first discharge port array group (array a of 5C) is multiplied by the first coefficient (=5), the amount of ink discharged from the second discharge port array group (array b of 5C) is multiplied by the second coefficient (=3), the amount of ink discharged from the third discharge port array group (array a of 5M) is multiplied by the third coefficient (=3), the amount of ink discharged from the fourth discharge port array group (array b of 5M) is multiplied by the fourth coefficient (=2), and so on. Likewise, the amounts of ink discharged from the subsequent discharge port array groups are multiplied by predetermined coefficients, up to the eighth discharge port array group (array b of 5Bk).

In contrast, during homebound printing, the eighth discharge port array group (array b of 5Bk) acts as the front discharge port array group in the moving direction. Thus, the effect of inflow air current occurring with the movement of the print head 5 is inverted relative to that during outbound printing. The amount of ink discharged from the eighth discharge port array group (array b of 5Bk) is multiplied by the first coefficient (=5), the amount of ink discharged from the seventh discharge port array group (array a of 5Bk) is multiplied by the second coefficient (=3), the amount of ink discharged from the sixth discharge port array group (array b of 5Y) is multiplied by the third coefficient (=3), the amount of ink discharged from the fifth discharge port array group (array a of 5Y) is multiplied by the fourth coefficient (=2), and so on. Likewise, the amounts of ink discharged from the subsequent discharge port array groups are multiplied by predetermined coefficients, up to the first discharge port array group (array a of 5C). Subsequently, wiping-operation control is performed similarly to that in the first embodiment.

According to this embodiment, the arrays for each color are defined as individual discharge port array groups, so that a coefficient set in view of the effect of inflow air current is applied to each ink discharge port array, thereby allowing for finer control than in the seventh and eighth embodiments.

Tenth Embodiment

Figure 18:
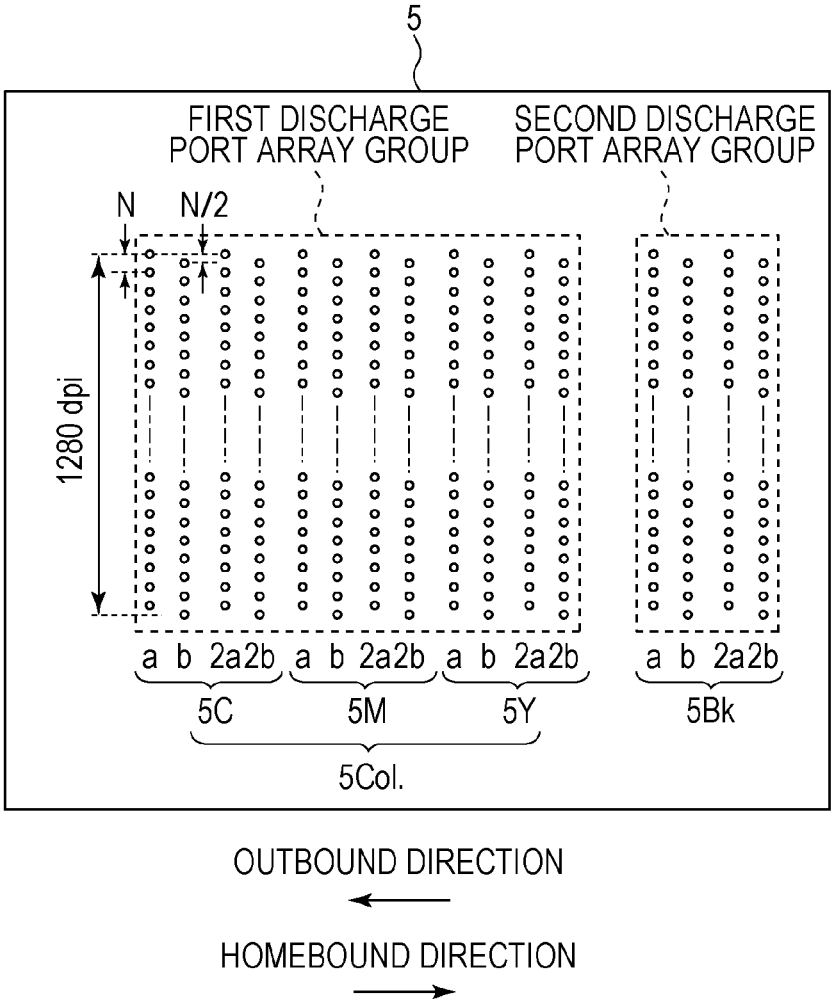
FIG. 18 schematically illustrates the configuration of a print head according to a tenth embodiment and the relationships among discharge port array groups.

FIG. 18 schematically illustrates the configuration of a print head 5 according to a tenth embodiment and the relationships among discharge port array groups. In this embodiment, the print head 5 has a color discharge port array 5Col in which discharge port arrays 5C, 5M, and 5Y respectively corresponding to the C, M, and Y inks are integrated, and also has a black discharge port array 5Bk corresponding to the Bk ink. Each color is provided with two sets of parallel-arranged discharge port arrays a and b shown in FIG. 15.

In the tenth embodiment, the color discharge port array 5Col surrounded by a dotted line in FIG. 18 is defined as a first discharge port array group, and the black discharge port array 5Bk is defined as a second discharge port array group. A wiping-operation control procedure in this case will be described below.

Similar to the first embodiment, wiping-operation control in this embodiment is performed based on the flowchart in FIG. 5. In this embodiment, predetermined coefficients are applied in accordance with the moving direction of the print head 5 based on the table shown in FIG. 6A.

The control procedure will be described with reference to the configuration of the print head 5 and the relationships among the discharge port arrays shown in FIG. 18 as an example. During outbound printing (leftward in FIG. 18), the first discharge port array group (5Col) acts as the front discharge port array group in the moving direction and is thus strongly affected by the inflow air current. Therefore, the amount of discharged ink is multiplied by the first coefficient (=5). The second discharge port array group (5Bk) acts as the rear discharge port array group and is less affected by the inflow air current. Therefore, the amount of discharged ink is multiplied by the second coefficient (=1), which is smaller than the first coefficient.

In contrast, during homebound printing, the second discharge port array group (5Bk) acts as the front discharge port array group in the moving direction, whereas the first discharge port array group (5Col) acts as the rear discharge port array group. Thus, the effect of inflow air current occurring with the movement of the print head 5 is inverted relative to that during outbound printing. The coefficient applied to the second discharge port array group becomes the first coefficient (=5), and the coefficient applied to the first discharge port array group becomes the second coefficient (=1). Subsequently, wiping-operation control is performed similarly to that in the first embodiment.

Eleventh Embodiment

Figure 19:
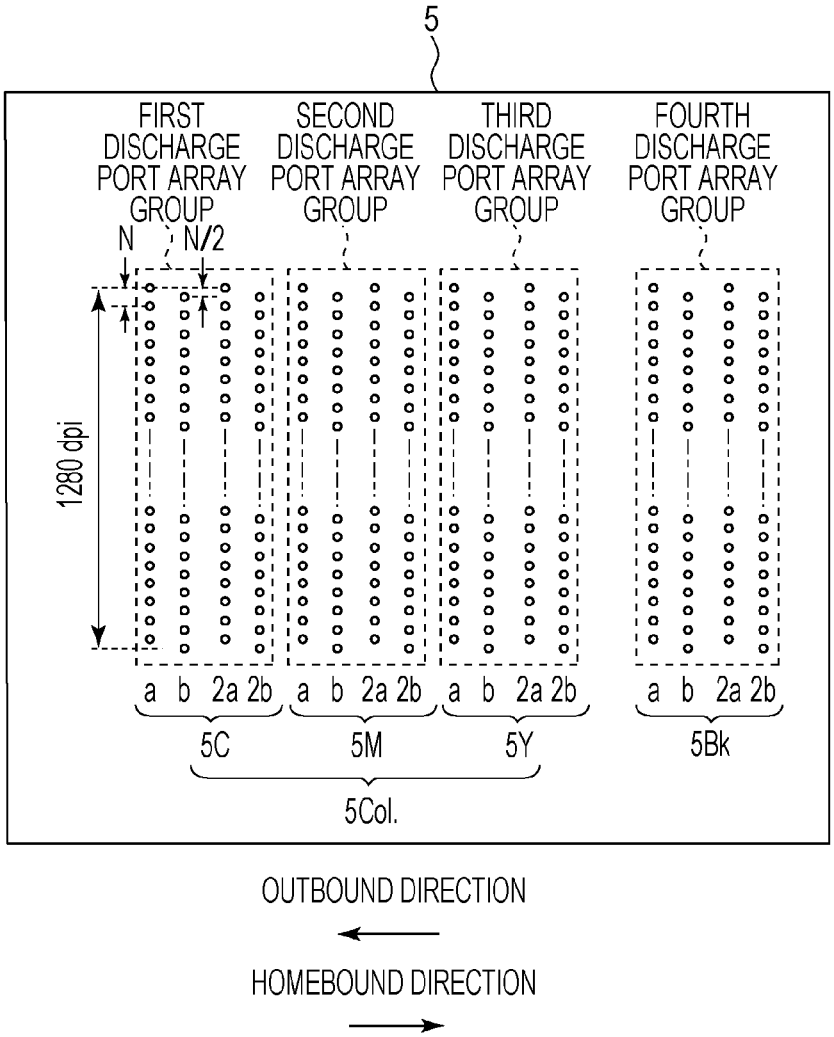
FIG. 19 schematically illustrates the configuration of a print head according to an eleventh embodiment and the relationships among discharge port array groups.

FIG. 19 schematically illustrates the configuration of a print head 5 according to an eleventh embodiment and the relationships among discharge port array groups. The configuration of the print head 5 is similar to that shown in FIG. 18. In the eleventh embodiment, the discharge portions 5C, 5M, 5Y, and 5Bk surrounded by respective dotted lines in FIG. 19 are defined as a first discharge port array group, a second discharge port array group, a third discharge port array group, and a fourth discharge port array group, respectively. A wiping-operation control procedure in this case will be described below.

Similar to the first embodiment, wiping-operation control is performed based on the flowchart in FIG. 5. In this embodiment, predetermined coefficients are applied in accordance with the moving direction of the print head 5 based on the table shown in FIG. 6B.

The control procedure will be described with reference to the configuration of the print head 5 and the relationships among the discharge port arrays shown in FIG. 19 as an example. The following description relates to an example where the effect of inflow air current weakens in a stepwise manner from the front side toward the rear side in the moving direction when the print head 5 moves. For example, during outbound printing (leftward in FIG. 19), the amount of ink discharged from the first discharge port array group (5C) is multiplied by the first coefficient (=5), and the amount of ink discharged from the second discharge port array group (5M) is multiplied by the second coefficient (=3). The amount of ink discharged from the third discharge port array group (5Y) is multiplied by the third coefficient (=2), and the amount of ink discharged from the fourth discharge port array group (5Bk) is multiplied by the fourth coefficient (=1).

In contrast, during homebound printing, the fourth discharge port array group (5Bk) acts as the front discharge port array group in the moving direction. Thus, the effect of inflow air current occurring with the movement of the print head 5 is inverted relative to that during outbound printing. The amount of ink discharged from the fourth discharge port array group (5Bk) is multiplied by the first coefficient (=5), and the amount of ink discharged from the third discharge port array group (5Y) is multiplied by the second coefficient (=3). The amount of ink discharged from the second discharge port array group (5M) is multiplied by the third coefficient (=2), and the amount of ink discharged from the first discharge port array group (5C) is multiplied by the fourth coefficient (=1). Subsequently, wiping-operation control is performed similarly to that in the first embodiment.

By setting a discharge port array group for each color as in this embodiment, a coefficient set in view of the effect of inflow air current is applied to each ink discharge port array, thereby allowing for finer control.

Twelfth Embodiment

Figure 20:
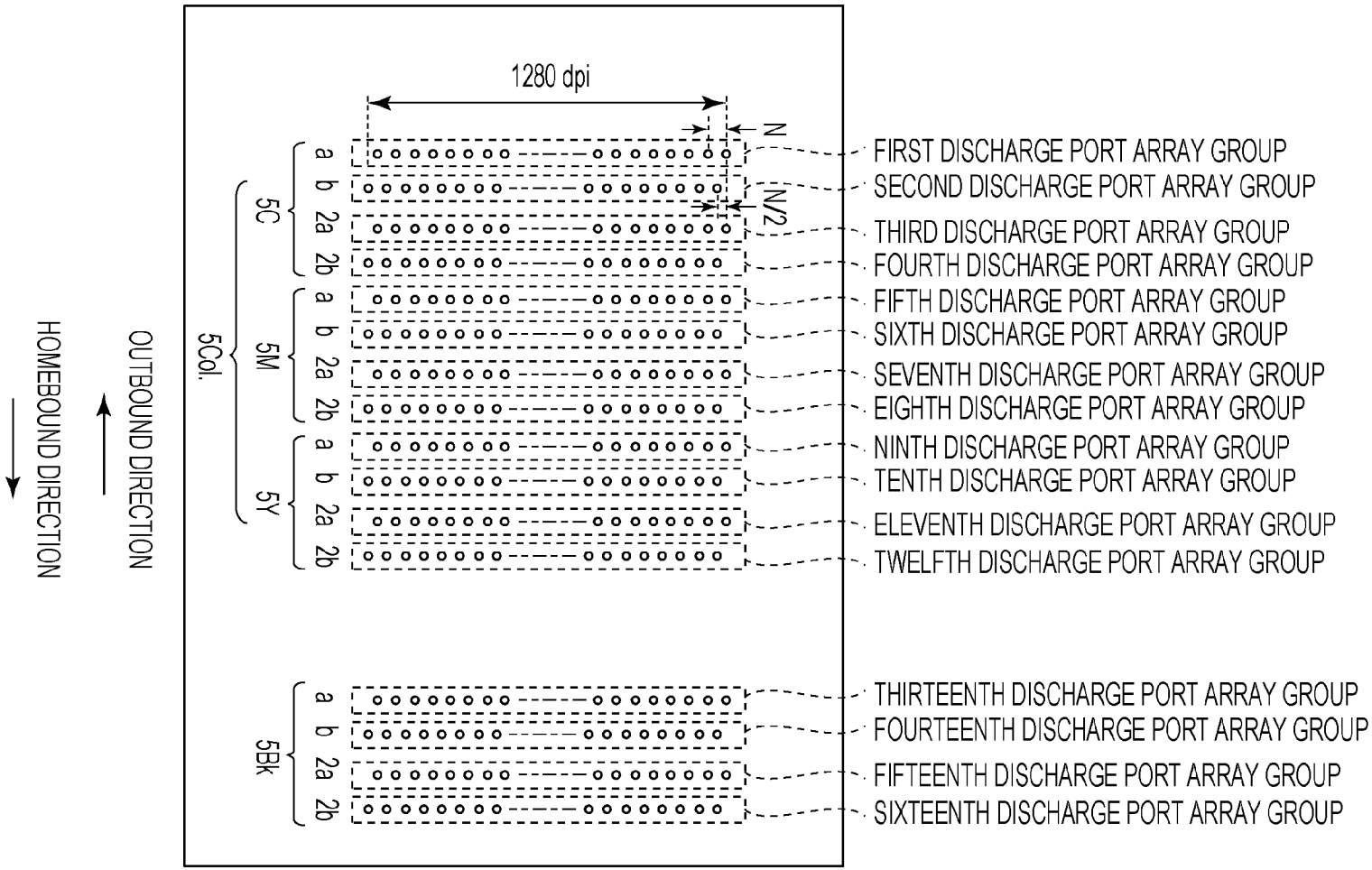
FIG. 20 schematically illustrates the configuration of a print head according to a twelfth embodiment and the relationships among discharge port array groups.

FIG. 20 schematically illustrates the configuration of a print head 5 according to a twelfth embodiment and the relationships among discharge port array groups. The configuration of the print head 5 is similar to that shown in FIG. 18. In the twelfth embodiment, the arrays (a, b, 2*a*, and 2*b*) for each color surrounded by respective dotted lines in FIG. 20 are defined as individual discharge port array groups. A wiping-operation control procedure in this case will be described below.

Similar to the first embodiment, wiping-operation control in this embodiment is performed based on the flowchart in FIG. 5. In this embodiment, predetermined coefficients are applied in accordance with the moving direction of the print head 5 based on the table shown in FIG. 14.

The control procedure will be described with reference to the configuration of the print head 5 and the relationships among the discharge port arrays shown in FIG. 20 as an example. The following description relates to an example where the effect of inflow air current weakens in a stepwise manner from the front side toward the rear side in the moving direction when the print head 5 moves. For example, during outbound printing (leftward in FIG. 20), the amount of ink discharged from the first discharge port array group (array a of 5C) is multiplied by the first coefficient (=5), the amount of ink discharged from the second discharge port array group (array b of 5C) is multiplied by the second coefficient (=5), the amount of ink discharged from the third discharge port array group (array 2*a* of 5C) is multiplied by the third coefficient (=3), the amount of ink discharged from the fourth discharge port array group (array 2*b* of 5C) is multiplied by the fourth coefficient (=3), and so on. Likewise, the amounts of ink discharged from the subsequent discharge port array groups are multiplied by predetermined coefficients, up to the sixteenth discharge port array group (array 2*b* of 5Bk).

In contrast, during homebound printing, the sixteenth discharge port array group (array 2*b* of 5Bk) acts as the front discharge port array group in the moving direction. Thus, the effect of inflow air current occurring with the movement of the print head 5 is inverted relative to that during outbound printing. The amount of ink discharged from the sixteenth discharge port array group (array 2*b* of 5Bk) is multiplied by the first coefficient (=5), the amount of ink discharged from the fifteenth discharge port array group (array 2*a* of 5Bk) is multiplied by the second coefficient (=5), the amount of ink discharged from the fourteenth discharge port array group (array b of 5Bk) is multiplied by the third coefficient (=3), the amount of ink discharged from the thirteenth discharge port array group (array a of 5Bk) is multiplied by the fourth coefficient (=3), and so on. Likewise, the amounts of ink discharged from the subsequent discharge port array groups are multiplied by predetermined coefficients, up to the first discharge port array group (array a of 5C). Subsequently, wiping-operation control is performed similarly to that in the first embodiment.

According to this embodiment, the arrays for each color are defined as individual discharge port array groups, so that a coefficient set in view of the effect of inflow air current is applied to each ink discharge port array, thereby allowing for finer control than in the tenth and eleventh embodiments.

Thirteenth Embodiment

Figure 21:
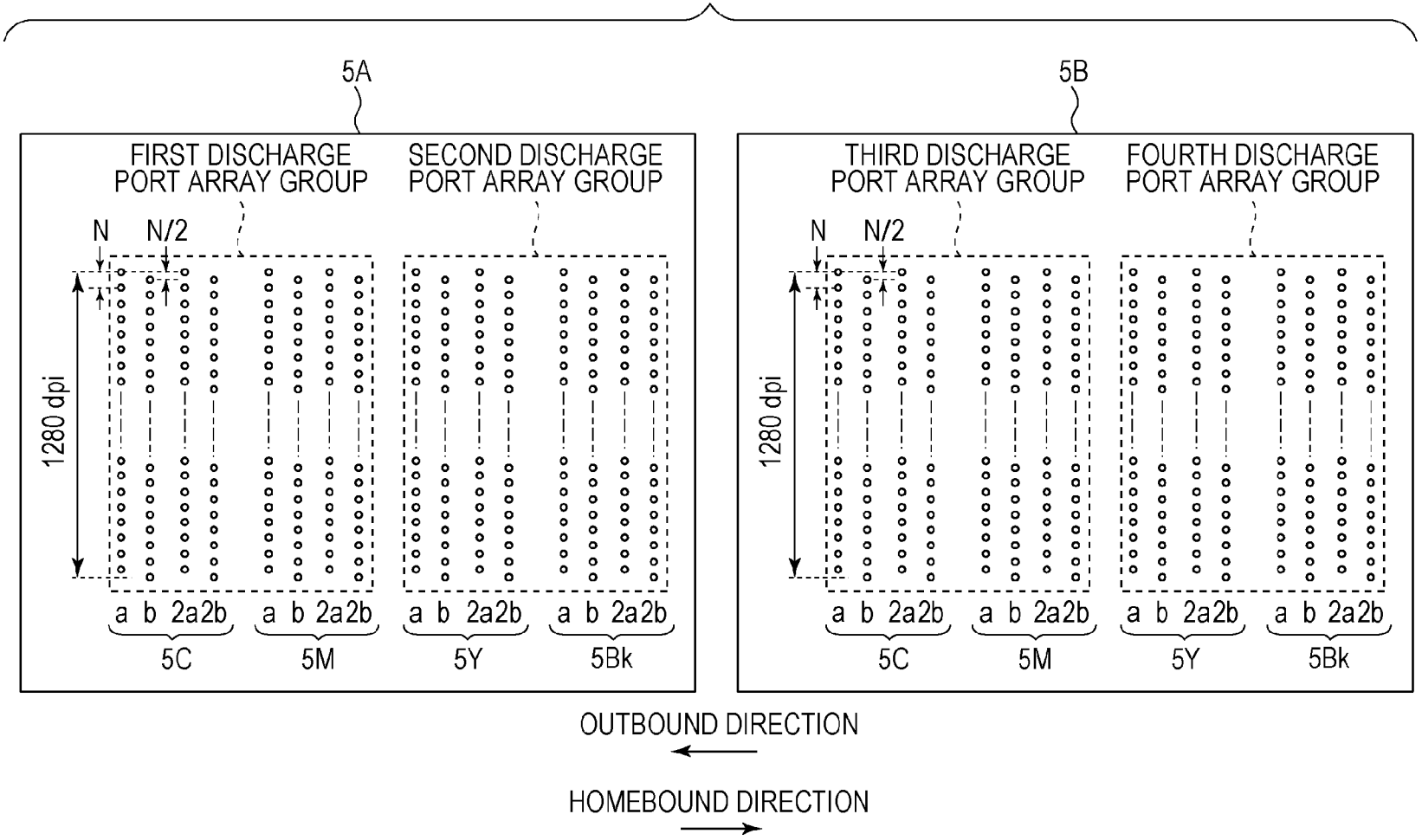
FIG. 21 schematically illustrates the configuration of print heads according to a thirteenth embodiment and the relationships among discharge port array groups.

FIG. 21 schematically illustrates the configuration of print heads according to a thirteenth embodiment and the relationships among discharge port array groups. This embodiment relates to an example of a so-called multi-head configuration in which two print heads are arranged in the moving direction thereof. The two print heads are a print head 5A and a print head 5B, respectively. The configuration of each print head is similar to that shown in FIG. 10. Alternatively, the configuration of the print heads and the order of the colors may be different between the print heads. This embodiment relates to a case where the two print heads have identical configurations.

The thirteenth embodiment relates to a case where discharge portions 5C and 5M and discharge portions 5Y and 5Bk, surrounded by respective dotted lines in FIG. 21, of the first print head 5A are defined as a first discharge port array group and a second discharge port array group, respectively, and discharge portions 5C and 5M and discharge portions 5Y and 5Bk, surrounded by respective dotted lines, of the second print head 5B are defined as a third discharge port array group and a fourth discharge port array group, respectively. A wiping-operation control procedure in this case will be described below.

Similar to the first embodiment, wiping-operation control in this embodiment is performed based on the flowchart in FIG. 5. In this embodiment, predetermined coefficients are applied in accordance with the moving direction of the print heads 5 based on the table shown in FIG. 6B.

The control procedure will be described with reference to the configuration of the print heads 5 and the relationships among the discharge port arrays shown in FIG. 21. The following description relates to an example where the effect of inflow air current weakens in a stepwise manner from the front side toward the rear side in the moving direction when the print heads 5 move. For example, during outbound printing (leftward in FIG. 21), the amount of ink discharged from the first discharge port array group (5C and 5M of the first print head 5A) is multiplied by the first coefficient (=5), and the amount of ink discharged from the second discharge port array group (5Y and 5Bk of the first print head 5A) is multiplied by the second coefficient (=3). The amount of ink discharged from the third discharge port array group (5C and 5M of the second print head 5B) is multiplied by the third coefficient (=2), and the amount of ink discharged from the fourth discharge port array group (5Y and 5Bk of the second print head 5B) is multiplied by the fourth coefficient (=1).

In contrast, during homebound printing, the fourth discharge port array group (5Y and 5Bk of the second print head 5B) acts as the front discharge port array group in the moving direction. Thus, the effect of inflow air current occurring with the movement of the print heads 5 is inverted relative to that during outbound printing. The amount of ink discharged from the fourth discharge port array group (5Y and 5Bk of the second print head 5B) is multiplied by the first coefficient (=5), and the amount of ink discharged from the third discharge port array group (5C and 5M of the second print head 5B) is multiplied by the second coefficient (=3). The amount of ink discharged from the second discharge port array group (5Y and 5Bk of the first print head 5A) is multiplied by the third coefficient (=2), and the amount of ink discharged from the first discharge port array group (5C and 5M of the first print head 5A) is multiplied by the fourth coefficient (=1). Subsequently, wiping-operation control is performed similarly to that in the first embodiment.

First Modification of Thirteenth Embodiment

Figure 22:
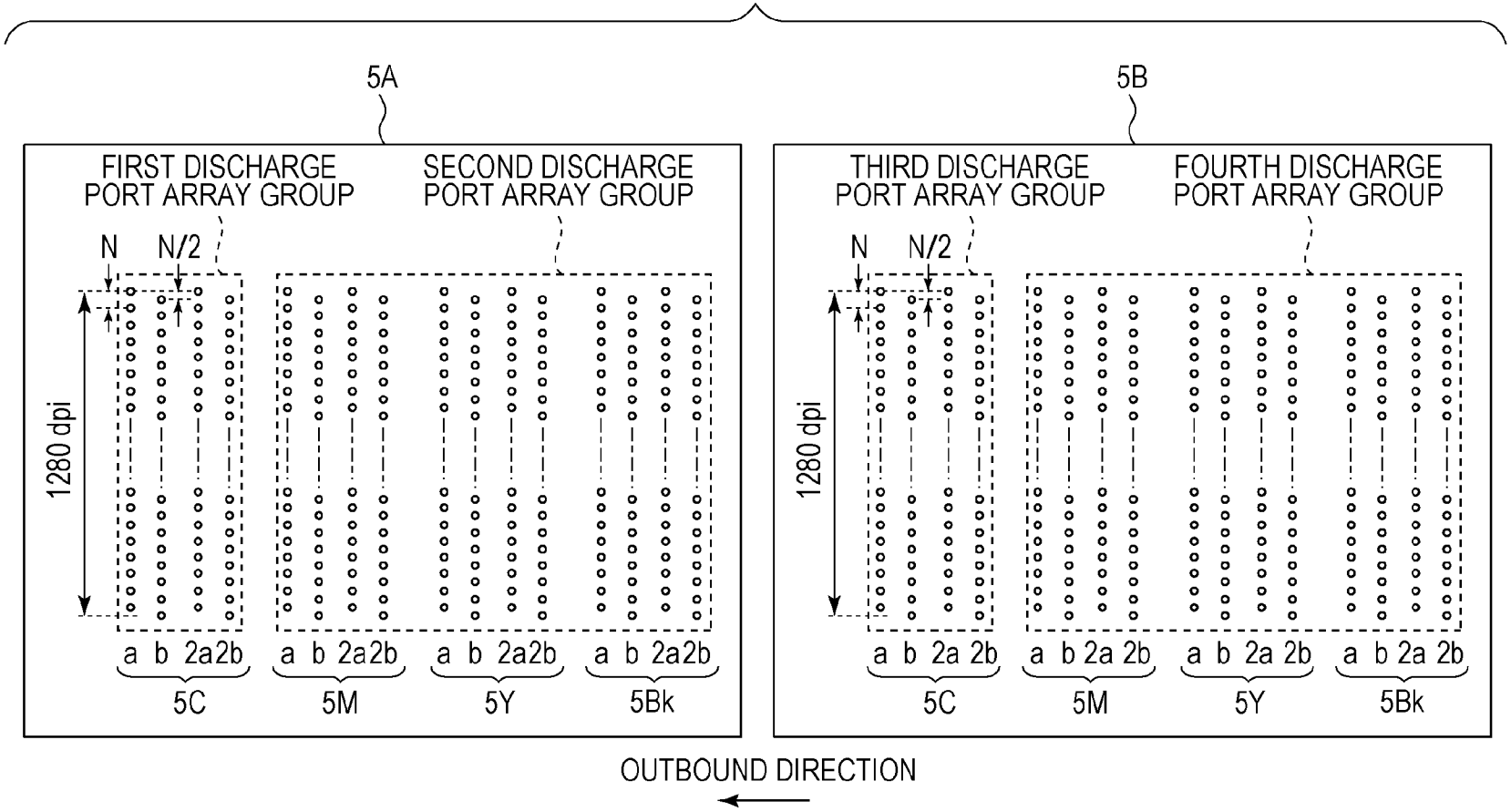
FIG. 22 schematically illustrates the configuration of print heads according to a modification of the thirteenth embodiment and the relationships among discharge port array groups.
Figure 23:
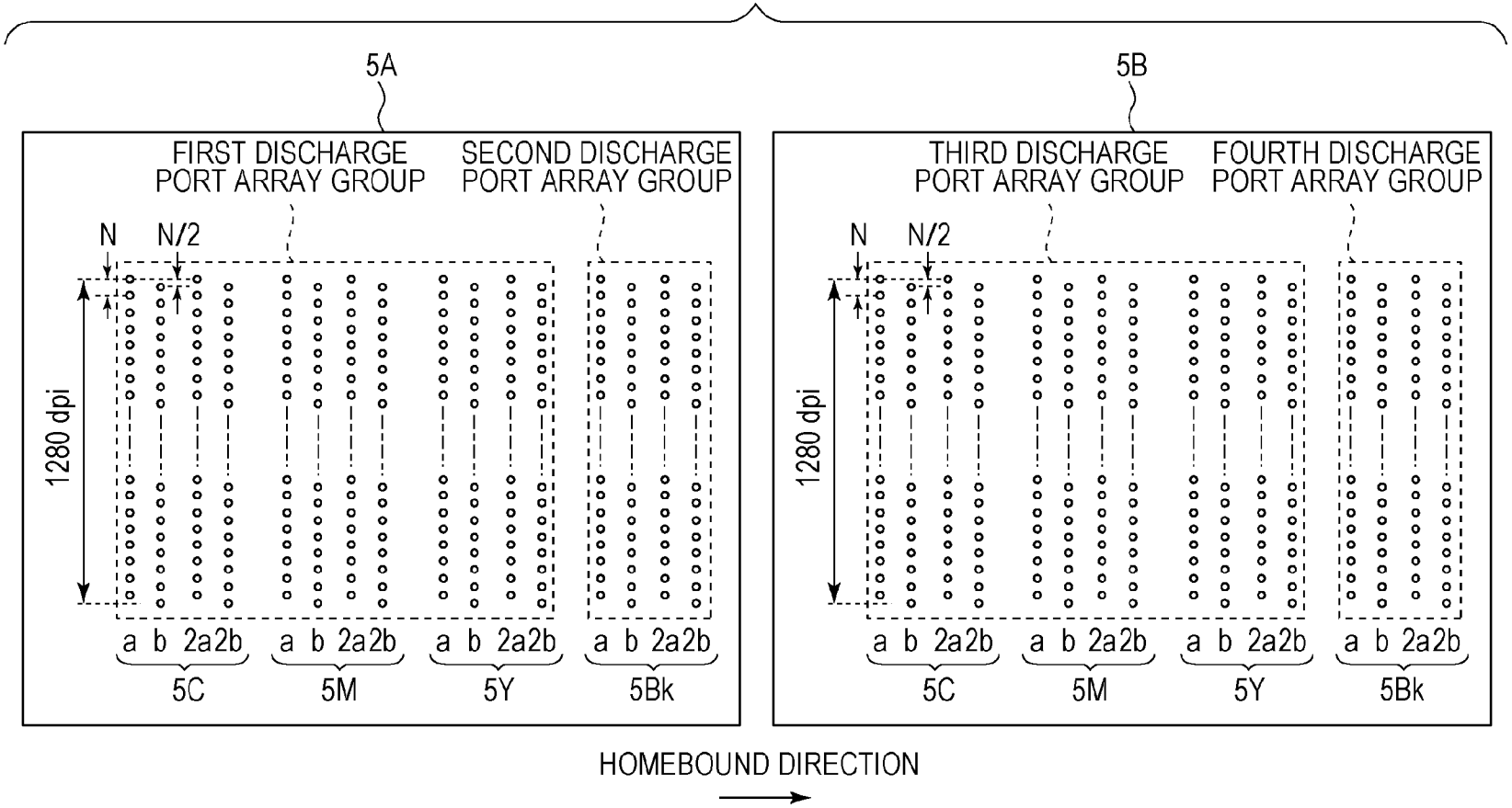
FIG. 23 schematically illustrates the configuration of print heads according to another modification of the thirteenth embodiment and the relationships among discharge port array groups.

FIGS. 22 and 23 illustrate modifications of FIG. 21. FIG. 22 illustrates a case where the discharge portion 5C of the first print head 5A is defined as the first discharge port array group, the discharge portions 5M, 5Y, and 5Bk of the first print head 5A are defined as the second discharge port array group, the discharge portion 5C of the second print head 5B is defined as the third discharge port array group, and the discharge portions 5M, 5Y, and 5Bk of the second print head 5B are defined as the fourth discharge port array group. FIG. 23 illustrates a case where the discharge portions 5C, 5M, and 5Y of the first print head 5A are defined as the first discharge port array group, the discharge portion 5Bk of the first print head 5A is defined as the second discharge port array group, the discharge portions 5C, 5M, and 5Y of the second print head 5B are defined as the third discharge port array group, and the discharge portion 5Bk of the second print head 5B is defined as the fourth discharge port array group.

Because the front discharge port array is the most affected by the inflow air current when the print head 5 moves, the front discharge port array when the print head 5 moves may be set as a single discharge port array group. For example, the discharge portion 5C of the first print head 5A may be defined as the first discharge port array group for outbound printing, as shown in FIG. 22, and the discharge portion 5Bk of the second print head 5B may be defined as the second discharge port array group for homebound printing, as shown in FIG. 23.

Accordingly, this embodiment is similar to the first embodiment in that the manner in which the discharge port array groups are defined is not limited to a single manner, and the discharge port arrays may be changed in accordance with the moving direction.

Second Modification of Thirteenth Embodiment

FIGS. 24A to 24D illustrate modifications of the coefficients to be applied to the discharge port array groups of the print heads. In a case where there are a plurality of print heads, the condition of air current between the print heads may sometimes change. Specifically, depending on the shape (recess) or the gap between the print heads, air may flow into the recess or the gap and create a vortex current in the area between the print heads. Thus, the front discharge port array (in this case, 5C) of the second print head 5B is strongly affected by the vortex current. Similar to the effect of inflow air current, the effect of this vortex current is known to relatively weaken toward the rear discharge port arrays (in this case, 5M, 5Y, and 5Bk).

In the table shown in FIG. 24A, for outbound printing, a coefficient applied to the first discharge port array group of the first print head 5A is 5, and a coefficient applied to the second discharge port array group is 1, which is smaller than the above coefficient. A coefficient applied to the third discharge port array group of the second print head 5B is 4, and a coefficient applied to the fourth discharge port array group is 1. Although the coefficient applied to the first discharge port array group is larger than the coefficient applied to the third discharge port array group in this case, the coefficient applied to the first discharge port array group may alternatively be smaller than or equal to the coefficient applied to the third discharge port array group.

For homebound printing, a coefficient applied to the fourth discharge port array group is 5, a coefficient applied to the third discharge port array group is 1, a coefficient applied to the second discharge port array group is 4, and a coefficient applied to the first discharge port array group is 1. Accordingly, the coefficients to be multiplied by the ink amounts of the discharge port arrays may be anomalous values, as in FIG. 24A, instead of decreasing in a stepwise manner from the front side in the print-head moving direction.

Third Modification of Thirteenth Embodiment

The table in FIG. 24B is another modification. It has been found that the condition of air current directly below the rearmost discharge port array of the print heads 5 changes in accordance with a change in the shape or the moving speed of the carriage 1. The same applies to a case of, for example, a printing apparatus having a blower based drying mechanism that blows air onto a printing medium to enhance the fixability of ink that has landed on the printing medium. In order to cope with such a case, the table in FIG. 24B is set such that a large coefficient is applied to the front discharge port array group in view of the effect of inflow air current, a small coefficient is applied to the intermediate portions, and a coefficient larger than the small coefficient is applied to the rearmost discharge port array group.

For outbound printing, a coefficient applied to the first discharge port array group of the first print head 5A is 5, and a coefficient applied to the second and third discharge port array groups is 1, which is smaller than the above coefficient. A coefficient applied to the fourth discharge port array group of the second print head 5B is 4. Although the coefficient applied to the first discharge port array group is larger than the coefficient applied to the fourth discharge port array group, the coefficient applied to the first discharge port array group may alternatively be smaller than or equal to the coefficient applied to the fourth discharge port array group.

For homebound printing, a coefficient applied to the fifth discharge port array group is 5, a coefficient applied to the third and second discharge port array groups is 1, and a coefficient applied to the first discharge port array group is 4. Subsequently, wiping-operation control is performed similarly to that in the first embodiment.

Fourteenth Embodiment

Figure 25:
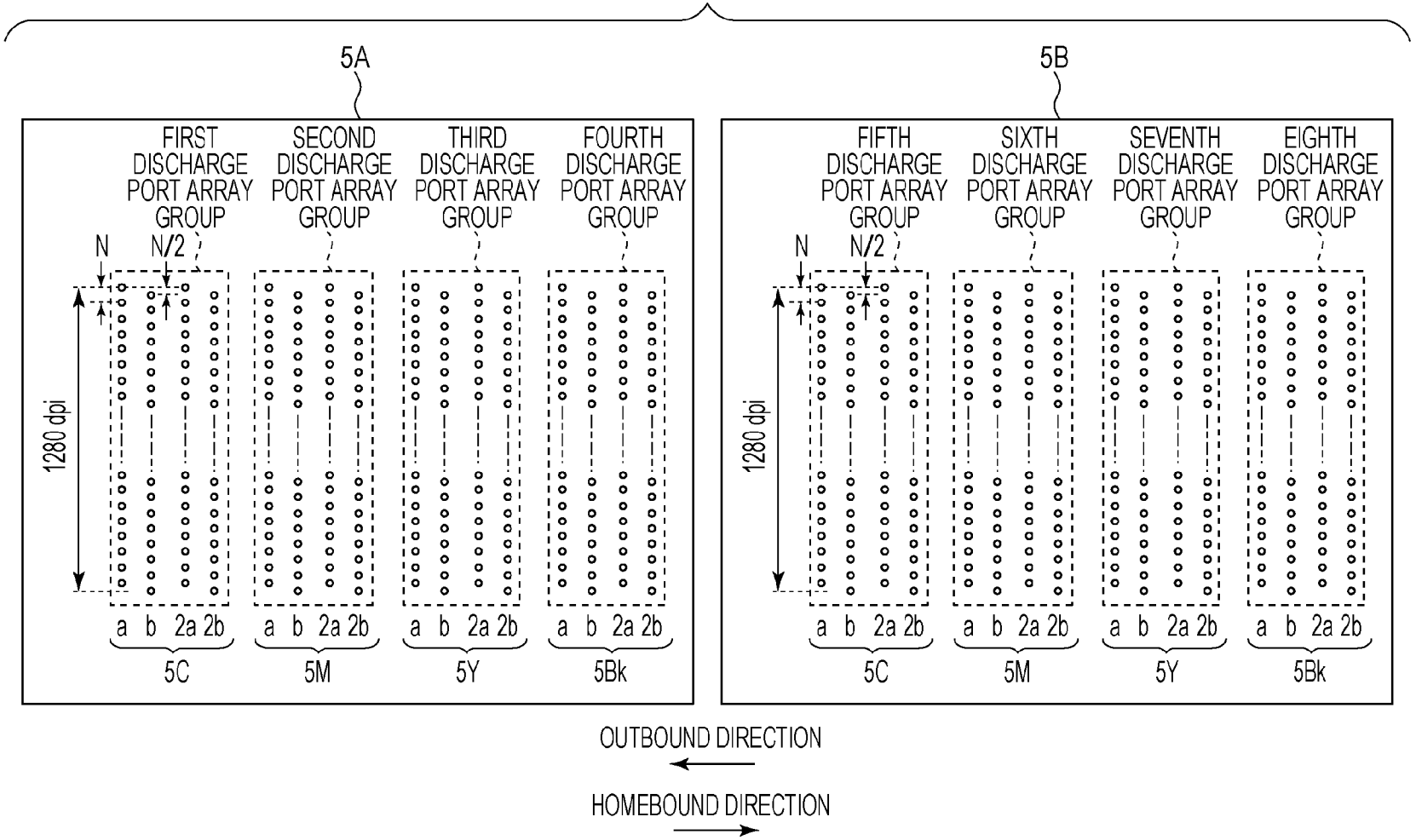
FIG. 25 schematically illustrates the configuration of print heads according to a fourteenth embodiment and the relationships among discharge port array groups.

FIG. 25 schematically illustrates the configuration of print heads 5 according to a fourteenth embodiment and the relationships among discharge port array groups. The configuration of the print heads 5 is similar to that in FIG. 21. In the fourteenth embodiment, the discharge portions 5C, 5M, 5Y, and 5Bk of the first print head 5A surrounded by respective dotted lines in FIG. 25 are defined as a first discharge port array group, a second discharge port array group, a third discharge port array group, and a fourth discharge port array group, respectively. Furthermore, the discharge portions 5C, 5M, 5Y, and 5Bk of the second print head 5B are defined as a fifth discharge port array group, a sixth discharge port array group, a seventh discharge port array group, and an eighth discharge port array group, respectively.

Similar to the first embodiment, wiping-operation control in this embodiment is performed based on the flowchart in FIG. 5. In this embodiment, predetermined coefficients are applied in accordance with the moving direction of the print heads 5 based on the table shown in FIG. 6C. A wiping-operation control procedure in this case will be described below.

The control procedure will be described with reference to the configuration of the print heads 5 and the relationships among the discharge port arrays shown in FIG. 25. The following description relates to an example where the effect of inflow air current weakens in a stepwise manner from the front side toward the rear side in the moving direction when the print heads 5 move. For example, during outbound printing (leftward in FIG. 25), the amount of ink discharged from the first discharge port array group (5C) of the first print head 5A is multiplied by the first coefficient (=5), the amount of ink discharged from the second discharge port array group (5M) is multiplied by the second coefficient (=3), the amount of ink discharged from the third discharge port array group (5Y) is multiplied by the third coefficient (=3), the amount of ink discharged from the fourth discharge port array group (5Bk) is multiplied by the fourth coefficient (=2), and so on. Likewise, the amounts of ink discharged from the subsequent discharge port array groups are multiplied by predetermined coefficients, up to the eighth discharge port array group (5Bk of the second print head 5B).

In contrast, during homebound printing, the eighth discharge port array group (5Bk of the second print head 5B) acts as the front discharge port array group in the moving direction. Thus, the effect of inflow air current occurring with the movement of the print heads 5 is inverted relative to that during outbound printing. The amount of ink discharged from the eighth discharge port array group (5Bk of the second print head 5B) is multiplied by the first coefficient (=5), the amount of ink discharged from the seventh discharge port array group (5Y) is multiplied by the second coefficient (=3), the amount of ink discharged from the sixth discharge port array group (5M) is multiplied by the third coefficient (=3), the amount of ink discharged from the fifth discharge port array group (5C) is multiplied by the fourth coefficient (=2), and so on. Likewise, the amounts of ink discharged from the subsequent discharge port array groups are multiplied by predetermined coefficients, up to the first discharge port array group (5C of the first print head 5A). Subsequently, wiping-operation control is performed similarly to that in the first embodiment.

According to this embodiment, the arrays for each color are defined as a discharge port array group, so that a coefficient set in view of the effect of inflow air current is applied to each ink discharge port array, thereby allowing for finer control than in the thirteenth embodiment.

Modification of Fourteenth Embodiment

FIG. 24C is similar to FIG. 24A in that control is performed in view of the effect of a change in air current between the print heads, but the discharge port array groups have been changed from four groups to eight groups. FIG. 24D is similar to FIG. 24B in that control is performed in view of the effect of a change in air current at the rearmost side of the print heads, but the discharge port array groups have been changed from four groups to eight groups. The control is performed based on a concept similar to those of the second and third modifications of the thirteenth embodiment.

Fifteenth Embodiment

Figure 26:
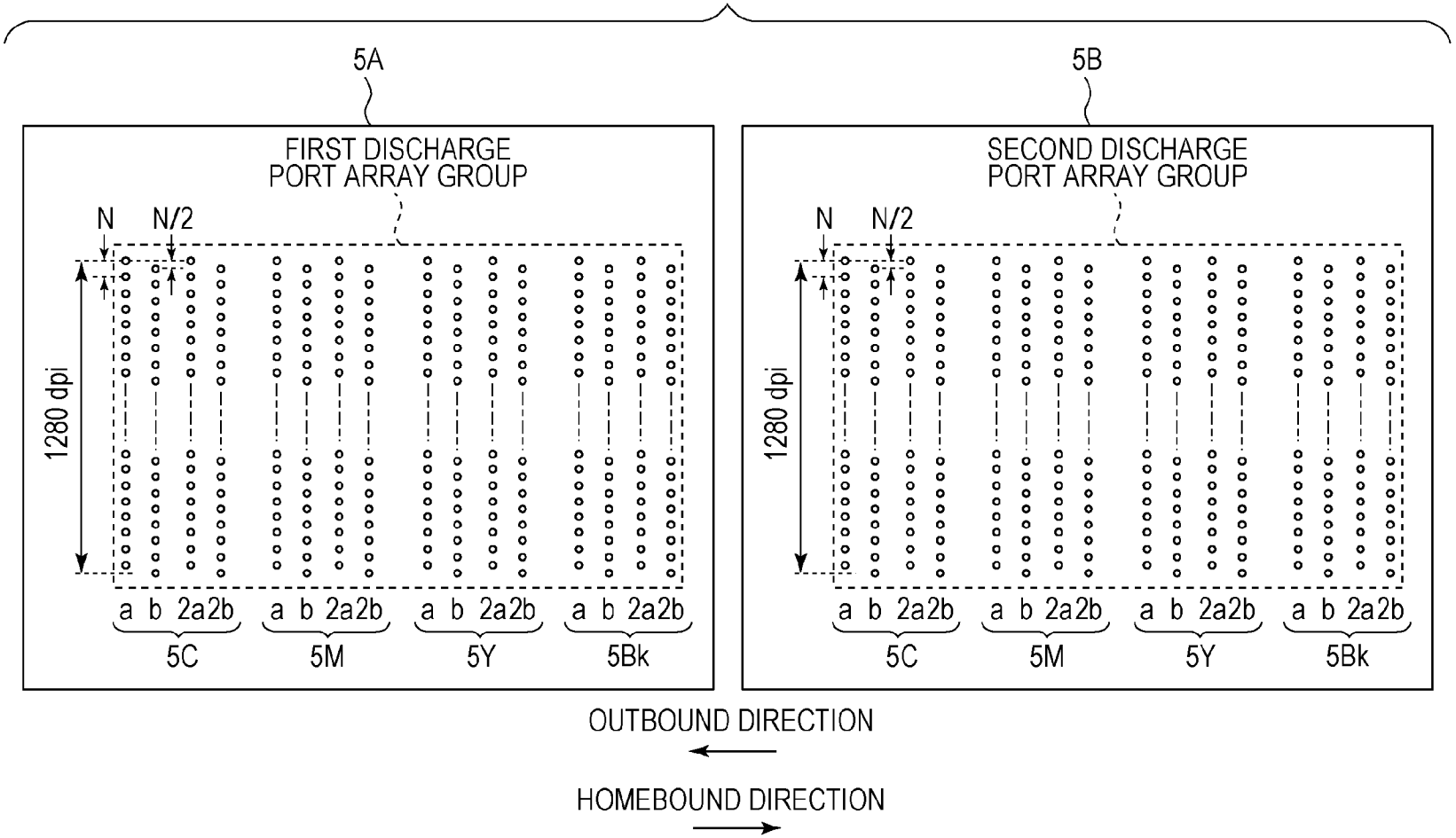
FIG. 26 schematically illustrates the configuration of print heads according to a fifteenth embodiment and the relationships among discharge port array groups.

FIG. 26 schematically illustrates the configuration of print heads 5 according to a fifteenth embodiment and the relationships among discharge port array groups. This embodiment relates to an example in which the discharge port arrays for the C, M, Y, and Bk colors in each print head are entirely integrated. In this embodiment, the discharge portions 5C, 5M, 5Y, and 5Bk of the first print head 5A surrounded by a dotted line in FIG. 26 are defined as a first discharge port array group, and the discharge portions 5C, 5M, 5Y, and 5Bk of the second print head 5B surrounded by another dotted line are defined as a second discharge port array group.

Similar to the first embodiment, wiping-operation control in this embodiment is performed based on the flowchart in FIG. 5. In this embodiment, predetermined coefficients are applied in accordance with the moving direction of the print heads 5 based on the table shown in FIG. 6A.

The control procedure will be described with reference to the configuration of the print heads 5 and the relationships among the discharge port arrays shown in FIG. 26. During outbound printing (leftward in FIG. 26), the first discharge port array group (5C, 5M, 5Y, and 5Bk of the first print head 5A) acts as the front discharge port array group in the moving direction and is thus strongly affected by the inflow air current. Therefore, the amount of discharged ink is multiplied by the first coefficient (=5). The second discharge port array group (5C, 5M, 5Y, and 5Bk of the second print head 5B) acts as the rear discharge port array group and is less affected by the inflow air current. Therefore, the amount of discharged ink is multiplied by the second coefficient (=1), which is smaller than the first coefficient.

In contrast, during homebound printing, the second discharge port array group (5C, 5M, 5Y, and 5Bk of the second print head 5B) acts as the front discharge port array group in the moving direction, whereas the first discharge port array group (5C, 5M, 5Y, and 5Bk of the first print head 5A) acts as the rear discharge port array group. Thus, the effect of inflow air current occurring with the movement of the print head 5 is inverted relative to that during outbound printing. The coefficient applied to the second discharge port array group becomes 5, and the coefficient applied to the first discharge port array group becomes 1. Subsequently, wiping-operation control is performed similarly to that in the first embodiment.

Sixteenth Embodiment

A sixteenth embodiment is particularly advantageous in a case where floating mist tends to occur easily due to factors other than the discharging conditions in the first embodiment. Specifically, such factors include a case where the inflow air current increases due to the moving speed of the print head 5, a case where the ink adhered to the discharge port surface tends to thicken or solidify easily, such as under a low-humidity environment, and a case where the distance between the print head 5 and the printing medium is large.

In this embodiment, a dot count value is multiplied by weighting coefficients in accordance with the "moving speed of the print head 5", "the distance between the print head 5 and the printing medium", and the "humidity in the environment in which the apparatus body is installed", in addition to the moving direction of the print head 5. If the obtained value is larger than or equal to a predetermined threshold value, a wiping operation is performed.

A simple example will be described here by using the flowchart in FIG. 5 based on the configuration of the print head 5 and the order of the colors in the first embodiment. First, in step S201, a single line's worth of print data is printed. In step S202, the number of times ink is discharged in accordance with the print data is integrated based on a dot count process. In step S203, the dot count value acquired in step S202 is multiplied by coefficients according to the moving speed of the print head 5, the distance between the print head 5 and the printing medium, and the humidity in the environment in which the apparatus body is installed based on tables shown in FIGS. 27A, 27B, and 27C. For example, with reference to the case where the inks are arranged in the order shown in FIG. 2, the moving speed of the print head 5 is 33.3 inches per second, the distance between the print head 5 and the printing medium is large, and the environmental humidity is lower than 30% as an example, the calculation expressions are as follows.

(Calculation Expression for Outbound Printing)
={Front Discharge Port Array Group (First Discharge Port Array Group) in Moving Direction× First Coefficient (=5)

+Rear Discharge Port Array Group (Second Discharge Port Array Group) in Moving Direction× Second Coefficient (=1)}×Coefficient According to Moving Speed of Print Head (=0.8)

×Coefficient According to Distance between Print Head and Printing Medium (=1.2)

×Coefficient According to Environment (=1)

(Calculation Expression for Homebound Printing)
={Front Discharge Port Array Group (Second Discharge Port Array Group) in Moving Direction×First Coefficient (=5)

+Rear Discharge Port Array Group (First Discharge Port Array Group) in Moving Direction×Second Coefficient (=1)}

×Coefficient According to Moving Speed of Print Head (=0.8)

×Coefficient According to Distance between Print Head and Printing Medium (=1.2)

×Coefficient According to Environment (=1)

Accordingly, the weighting coefficients to be multiplied by the dot count value are changed in accordance with the moving speed, the distance between the print head 5 and the printing medium, and the installation environment of the apparatus body, in addition to the moving direction of the print head 5. Thus, the amount of mist adhered to each ink discharge port array can be ascertained more accurately. According to this embodiment, deterioration of image quality caused by, for example, a discharge defect or color mixing occurring due to adhesion of floating mist on the discharge port surface can be more reliably prevented than in the first to fifteenth embodiments.

Seventeenth Embodiment

A seventeenth embodiment relates to an example in which the strength of a wiping operation, particularly, the number of times wiping is performed in a single wiping operation, is controlled. This embodiment is particularly advantageous in a case where a predetermined amount of ink adhered to the discharge port surface cannot be scraped off therefrom in a single wiping operation.

Figure 28:
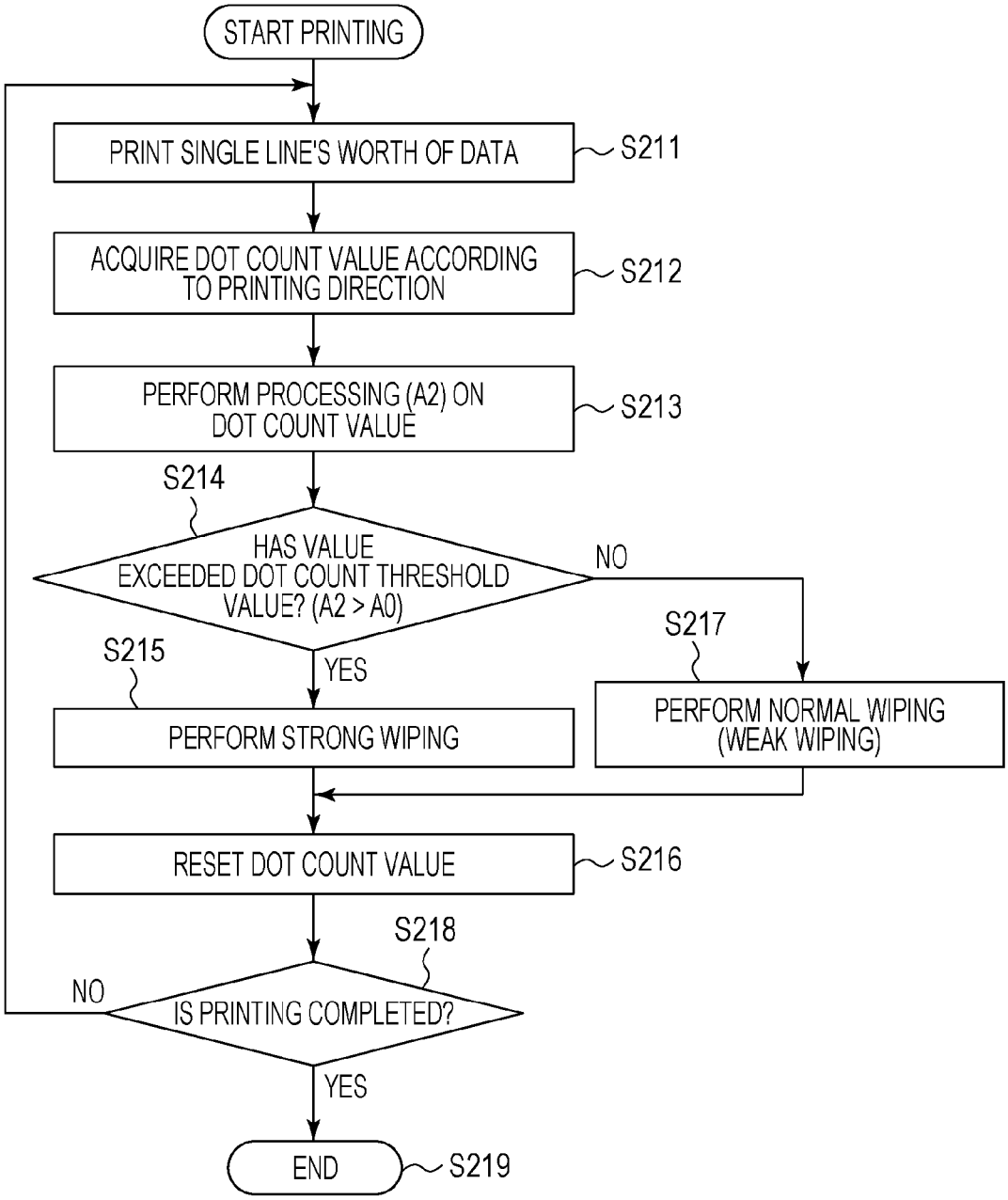
FIG. 28 is a flowchart illustrating a wiping-strength control procedure according to a seventeenth embodiment.

FIG. 28 is a flowchart illustrating a wiping-operation control procedure according to this embodiment. The ink adhered to the discharge port surface of the print head 5 is scraped off from the discharge port surface by being wiped off therefrom using the wipers 32A and 32B. Although a wiping process is normally performed once in a single wiping operation performed at every predetermined unit, it may sometimes be not possible to scrape off a desired amount of ink in a single wiping process if the adhered ink has thickened. In this case, the wiping process is performed multiple consecutive times instead of once, so that the ink that could not be scraped off in a single process can be actively scraped off. In this embodiment, control is performed such that the wiping process is performed two consecutive times, where necessary, in addition to the normal single wiping process. The wiping process is performed for scraping off a desired amount of ink adhered to the discharge port surface, and the number of times the scraping process is performed is not limited to twice and may alternatively be three times or more.

In this embodiment, a dot count value is multiplied by weighting coefficients in accordance with the "moving speed of the print head 5", the moving speed of the print head 5", the "distance between the print head 5 and the printing medium", and the "humidity in the environment in which the apparatus body is installed". If the obtained value is larger than or equal to a predetermined threshold value, control is performed such that wiping is performed multiple consecutive times in a single wiping operation.

First, in step S211, a single line's worth of print data is printed. In step S212, the number of times ink is discharged in accordance with the print data is integrated based on a dot count process. In step S213, the dot count value acquired in step S212 is multiplied by coefficients. The coefficients vary depending on the moving direction and the moving speed of the print head 5, the distance between the print head 5 and the printing medium, and the humidity in the environment in which the apparatus body is installed based on FIGS. 24A, 24B, and 24C. For example, with reference to the case where the inks are arranged in the order shown in FIG. 2, the moving speed of the print head 5 is 33.3 inches per second, the distance between the print head 5 and the printing medium is large, and the environmental humidity is lower than 30% as an example, the calculation expressions are as follows.

(Calculation Expression for Outbound Printing)
={Front Discharge Port Array Group (First Discharge Port Array Group) in Moving Direction× First Coefficient (=5)

+Rear Discharge Port Array Group (Second Discharge Port Array Group) in Moving Direction× Second Coefficient (=1)}

×Coefficient According to Moving Speed of Print Head (=0.8)

×Coefficient According to Distance between Print Head and Printing Medium (=1.2)

×Coefficient According to Environment (=1)

(Calculation Expression for Homebound Printing) ={Front Discharge Port Array Group (Second Discharge Port Array Group) in Moving Direction×First Coefficient (=5)

+Rear Discharge Port Array Group (First Discharge Port Array Group) in Moving Direction×Second Coefficient (=1)}

×Coefficient According to Moving Speed of Print Head (=0.8)

×Coefficient According to Distance between Print Head and Printing Medium (=1.2)

×Coefficient According to Environment (=1)

Similar to the first to sixteenth embodiments, each ink discharge amount in the above expressions is calculated by multiplying the amount of ink discharged per single discharge by a dot count value. Each ink discharge amount is a given value determined from, for example, the ink used and the configuration of the head (particularly, nozzles). Subsequently, in step S214, it is determined whether or not each of the weighted values is larger than or equal to a predetermined threshold value. If it is determined that the value is larger than or equal to the predetermined threshold value, a wiping operation is performed two consecutive times in step S215. Then, in step S216, the dot count value is reset. The process then proceeds to step S218 where it is determined whether or not the printing operation is completed. If it is determined that the printing operation is not completed, the process returns to step S211 to print the next single line's worth of print data.

In contrast, if it is determined that the printing operation is completed, the process proceeds to step S219 to end the procedure. Furthermore, if it is determined in step S214 that the weighted value is smaller than the predetermined threshold value, the process proceeds to step S217 to perform a wiping operation for the usual number of times. Then, in step S216, the dot count value is reset. The process then proceeds to step S218 where it is determined whether or not the printing operation is completed. If it is determined that the printing operation is not completed, the process returns to step S211 to print the next single line's worth of print data. If it is determined that the printing operation is completed, the process proceeds to step S219 to end the procedure.

Accordingly, the weighting coefficients to be multiplied by the dot count value are changed in accordance with the moving direction and the moving speed of the print head 5, the distance between the print head 5 and the printing medium, and the installation environment of the apparatus body. Thus, the amount of mist adhered to each ink discharge port array can be ascertained more accurately.

This embodiment is similar to the first to sixteenth embodiments in that deterioration of image quality caused by, for example, a discharge defect or color mixing occurring due to adhesion of floating mist on the discharge port surface can be reliably prevented.

Eighteenth Embodiment

This embodiment relates to a control example in which a recovery operation is executed by preliminarily discharging ink after a wiping operation. It is preferable that a predetermined amount of ink be preliminarily discharged after a wiping operation. This is mainly due to the following two reasons. The first reason is as follows. Mist adhered to the discharge port surface prior to a wiping operation may have thickened due to, for example, evaporation of ink solvent component occurring with discharging of ink, evaporation of ink solvent component caused by wind occurring with the movement of the carriage, or evaporation of ink solvent component caused by heat in the vicinity of the print head. In this case, the thickened ink may be pushed into the nozzles as a result of a wiping operation. If a discharging operation (main discharging operation) for printing is subsequently performed without performing preliminary discharging, a discharge defect may possibly occur. The second reason is as follows. If a print head 5 having integrated therein discharge portions for multiple colors and a wiper that is shared among some of the ink colors are used, an ink of a certain color adhered on the discharge port surface may be pushed into nozzles for another ink color as a result of a wiping operation. In this case, if a main discharging operation is subsequently performed without performing preliminary discharging, color mixing may possibly occur. Therefore, by performing preliminary discharging to drain the thickened ink or the different-color ink pushed into the nozzles, these problems can be avoided.

In this embodiment, a dot count value is weighted in accordance with the moving direction and the moving speed of the print head, the distance between the print head and the printing medium, and the installation environment of the apparatus body. If the obtained value is larger than or equal to a predetermined threshold value, the amount of ink to be preliminarily discharged, specifically, the number of times ink is to be preliminarily discharged, is controlled.

For example, as shown in FIG. 27D, the number of printed sheets from a previous wiping operation is counted and the number of times preliminary discharging is to be performed after the wiping operation is controlled in accordance with the count value. Specifically, if the number of printed sheets after the previous wiping operation is large, it is conceivable that the amount of mist adhered to the discharge port surface is large. Thus, the number of times preliminary discharging is to be performed is increased, assuming that a large amount of ink has thickened or a large amount of different-color ink is pushed into the nozzles as a result of the wiping operation. In contrast, if the number of printed sheets after the previous wiping operation is small, it is conceivable that the amount of mist adhered to the discharge port surface is small. Thus, the number of times preliminary discharging is to be performed is reduced, assuming that a small amount of ink has thickened or a small amount of different-color ink is pushed into the nozzles as a result of the wiping operation.

Accordingly, in this embodiment, a recovery operation is executed by performing preliminary discharging after a wiping operation so that deterioration of printing quality, such as a discharge defect or color mixing, can be prevented. In the case where the number of times preliminary discharging is to be performed after a wiping operation is to be changed in accordance with the number of printed sheets, as in the above embodiment, a dot count value may be reset after performing preliminary discharging. Furthermore, in this embodiment, the amount of ink to be preliminarily discharged after a wiping operation may be changed in accordance with the number of printed sheets. For example, the amount of ink discharged per droplet may be changed.

Figure 29:
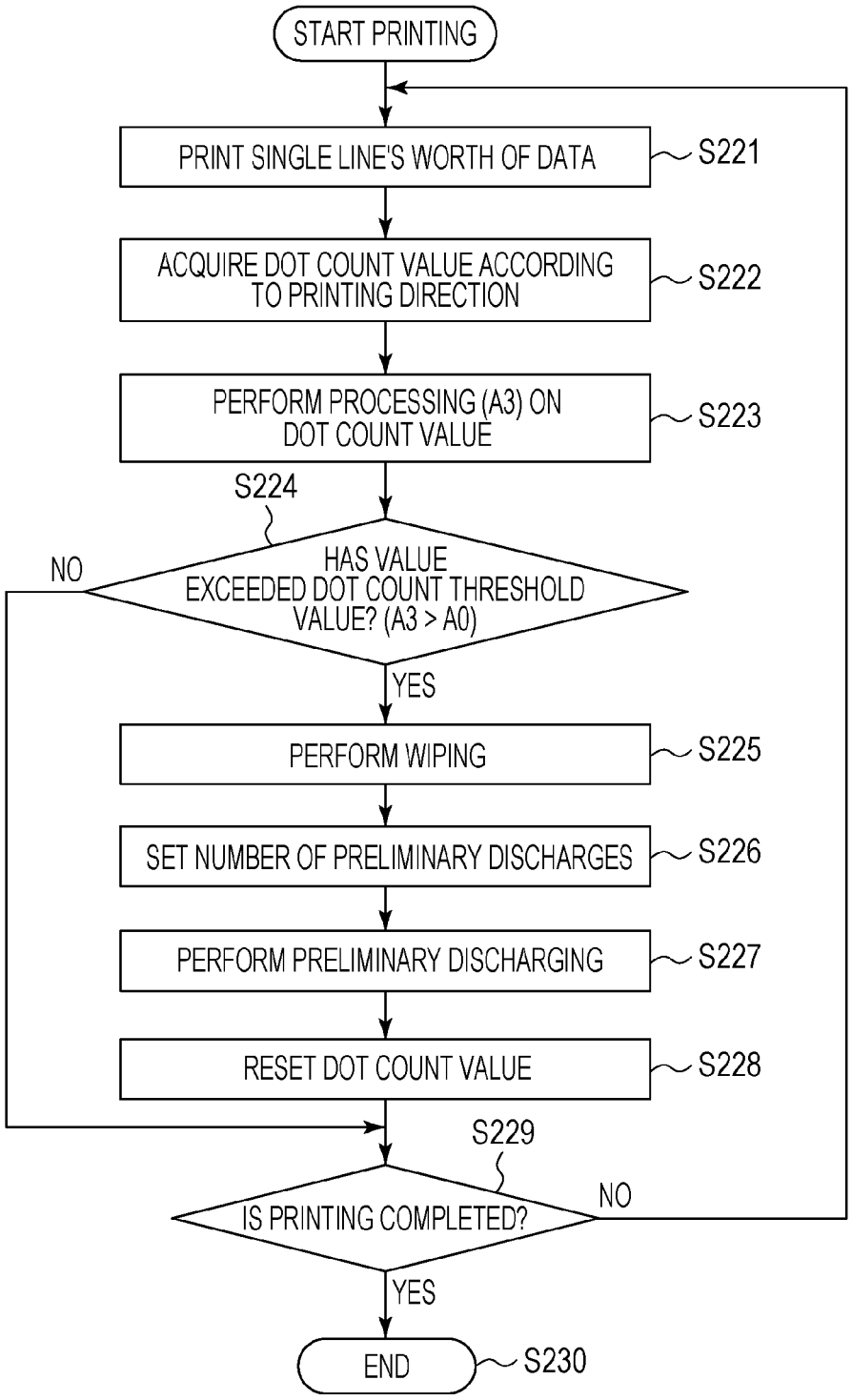
FIG. 29 is a flowchart illustrating a preliminary-discharging-operation control procedure according to an eighteenth embodiment.

This embodiment will be described with reference to a flowchart shown in FIG. 29. First, in step S221, a single line's worth of print data is printed. In step S222, the number of times ink is discharged in accordance with the print data is integrated based on a dot count process. In step S223, the dot count value acquired in step S222 is multiplied by coefficients in a manner similar to the above embodiments. For example, with reference to the case where the inks are arranged in the order shown in FIG. 4, the moving speed of the print head is 24 inches per second, the distance between the print head and the printing medium is small, and the environmental humidity is higher than or equal to 60%, the calculation expressions are as follows.

(Calculation Expression for Outbound Printing)
={Front Discharge Port Array Group (First Discharge Port Array Group) in Moving Direction× First Coefficient (=5)

+Rear Discharge Port Array Group (Second Discharge Port Array Group) in Moving Direction× Second Coefficient (=1)}

×Coefficient According to Moving Speed of Print Head (=0.6)

×Coefficient According to Distance between Print Head and Printing Medium (=0.4)

×Coefficient According to Environment (=0.8)

(Calculation Expression for Homebound Printing)
={Front Discharge Port Array Group (Second Discharge Port Array Group) in Moving Direction×First Coefficient (=5)

+Rear Discharge Port Array Group (First Discharge Port Array Group) in Moving Direction×Second Coefficient (=1)}

×Coefficient According to Moving Speed of Print Head (=0.6)

×Coefficient According to Distance between Print Head and Printing Medium (=0.4)

×Coefficient According to Environment (=0.8)

Subsequently, in step S224, it is determined whether or not each of the weighted values is larger than or equal to a predetermined threshold value. If it is determined that the value is larger than or equal to the predetermined threshold value, a wiping operation is performed in step S225, and the number of times preliminary discharging is to be performed is set based on the table shown in FIG. 27D in step S226. Then, in step S227, preliminary discharging is performed. In step S228, the dot count value is reset. In step S229, it is determined whether or not the printing operation is completed. If it is determined that the printing operation is not completed, the process returns to step S221 to print the next single line's worth of print data. In contrast, if it is determined that the printing operation is completed, the process proceeds to step S230 to end the procedure.

If it is determined in step S224 that the weighted value is smaller than the predetermined threshold value, the process proceeds to step S229 to similarly determine whether or not the printing operation is completed. If it is determined that the printing operation is not completed, the process returns to step S221 to print the next single line's worth of print data. If it is determined that the printing operation is completed, the process proceeds to step S230 to end the procedure.

Accordingly, in this embodiment, the number of times preliminary discharging is to be performed after a wiping operation is controlled in view of the moving direction and the moving speed of the print head, the distance between the print head and the printing medium, and the installation environment of the apparatus body. Consequently, deterioration of image quality caused by, for example, a discharge defect or color mixing occurring due to adhesion of floating mist on the discharge port surface can be reliably prevented.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-082601 filed Apr. 14, 2015, which is hereby incorporated by reference herein in its entirety.

What is claimed is:

1. An inkjet printing apparatus comprising:

a print head provided with a plurality of discharge port arrays, each discharge port array having a plurality of discharge ports, which discharge ink, arranged in a first direction, the plurality of discharge port arrays being provided in a second direction intersecting the first direction;

a carriage configured to reciprocate in the second direction with the print head mounted thereon;

a recovery unit configured to perform a recovery operation for recovering printing performance of the print head; and a controller configured to cause the recovery unit to perform the recovery operation based on a total value of a first value and a second value, wherein assuming that a front discharge port array and a rear discharge port array of the plurality of discharge port arrays provided in the print head when the carriage moves in an outbound direction are defined as a first discharge port array and a second discharge port array, respectively, the first value is obtained by multiplying a sum of an amount of ink discharged from the first discharge port array when the carriage moves in the outbound direction and an amount of ink discharged from the second discharge port array when the carriage moves in a homebound direction by a first coefficient, and the second value is obtained by multiplying a sum of an amount of ink discharged from the second discharge port array when the carriage moves in the outbound direction and an amount of ink discharged from the first discharge port array when the carriage moves in the homebound direction by a second coefficient, the second coefficient is smaller than the first coefficient.

2. The inkjet printing apparatus according to claim 1, wherein the controller causes the recovery unit to perform the recovery operation if the total value is larger than a predetermined threshold value.

3. The inkjet printing apparatus according to claim 1, wherein when calculating the total value, at least one of the first value and the second value is further multiplied by a coefficient in accordance with a moving speed of the carriage.

4. The inkjet printing apparatus according to claim 1, wherein when calculating the total value, at least one of the first value and the second value is further multiplied by a coefficient in accordance with a distance between the carriage and a printing medium.

5. The inkjet printing apparatus according to claim 1, wherein when calculating the total value, at least one of the first value and the second value is further multiplied by a coefficient in accordance with an environment in which a printing apparatus body is installed.

6. The inkjet printing apparatus according to claim 1, wherein the recovery unit is a wiping mechanism that performs the recovery operation by wiping a discharge port surface provided with the discharge port arrays.

7. The inkjet printing apparatus according to claim 6, wherein the controller sets the number of times the discharge port surface is to be wiped by the wiping mechanism when the total value is larger than a predetermined threshold value to be larger than the number of times the discharge port surface is to be wiped by the wiping mechanism when the total value is smaller than the predetermined threshold value.

8. The inkjet printing apparatus according to claim 1, wherein the recovery unit is a preliminary discharging unit configured to cause the print head to perform preliminary discharging.

9. The inkjet printing apparatus according to claim 8, wherein the controller sets the number of times preliminary discharging is to be performed by the print head when the total value is larger than a predetermined threshold value to be larger than the number of times preliminary discharging is to be performed by the print head when the total value is smaller than the predetermined threshold value.

10. The inkjet printing apparatus according to claim 1, wherein amounts of ink discharged for each respective port in each direction are dot count values which represent a number of times that ink was discharged from each respective port in each direction since the recovery unit last performed the recovery operation.

* * * * *